US009371209B2

(12) United States Patent
Walsh et al.

(10) Patent No.: US 9,371,209 B2
(45) Date of Patent: Jun. 21, 2016

(54) SINGLE PATH SINGLE WEB SINGLE-FOLD INTERFOLDER AND METHODS

(75) Inventors: James Andrew Walsh, Ashland, WI (US); Tad T. Butterworth, Ashland, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 674 days.

(21) Appl. No.: 13/460,960

(22) Filed: May 1, 2012

(65) Prior Publication Data

US 2013/0296153 A1 Nov. 7, 2013

(51) Int. Cl.

| | |
|---|---|
| ***B65H 45/24*** | (2006.01) |
| *B65H 45/22* | (2006.01) |
| *B65H 45/30* | (2006.01) |
| *B65H 45/16* | (2006.01) |

(52) U.S. Cl.

CPC ..... *B65H 45/24* (2013.01); *B65H 45/165* (2013.01); *B65H 45/22* (2013.01); *B65H 45/30* (2013.01); *B65H 2301/436* (2013.01)

(58) Field of Classification Search

CPC .. B65H 45/22; B65H 45/30; B65H 2301/436; B65H 2511/224; B65H 45/142; B65H 45/163; B65H 45/165; B65H 45/167; B65H 45/168

See application file for complete search history.

(56) References Cited

U.S. PATENT DOCUMENTS

| | | | |
|---|---|---|---|
| 940,933 | A | 11/1909 | Klein |
| 2,057,879 | A | 10/1936 | Campbell |
| 2,809,082 | A | 10/1957 | Marcuse |
| 3,163,413 | A | 12/1964 | Franke et al. |
| 3,301,111 | A | 1/1967 | Nystrand |
| 3,363,896 | A | 1/1968 | McKindary |
| 3,460,825 | A | 8/1969 | Mets et al. |
| 3,489,406 | A | 1/1970 | Nystrand |
| 3,659,840 | A | 5/1972 | Ruck |
| 3,679,095 | A | 7/1972 | Nissen et al. |
| 3,762,697 | A | 10/1973 | Bolza-Schünemann |
| 3,784,186 | A | 1/1974 | Lenthall et al. |
| 3,841,620 | A | 10/1974 | Lee et al. |
| 3,841,621 | A | 10/1974 | Brown |
| 3,845,948 | A | 11/1974 | Furbeck et al. |
| 3,850,425 | A | 11/1974 | Marcalus et al. |
| 3,947,013 | A | 3/1976 | Nystrand |
| 3,980,289 | A | 9/1976 | Harm |
| 3,980,291 | A | 9/1976 | Loase |
| 3,991,994 | A | 11/1976 | Farish |

(Continued)

FOREIGN PATENT DOCUMENTS

| | | | |
|---|---|---|---|
| DE | 4118097 | A1 | 12/1992 |
| EP | 0 302 031 | A2 | 2/1989 |

(Continued)

OTHER PUBLICATIONS

U.S. Appl. No. 12/977,393, filed Dec. 23, 2010, Butterworth.

*Primary Examiner* — Sameh Tawfik

(74) *Attorney, Agent, or Firm* — Reinhart Boerner Van Deuren P.C.

(57) ABSTRACT

Embodiments of the present invention provide new and improved folding apparatuses and methods for interfolding a continuous stream of sheets into a single-fold interfolded pattern of sheets while passing all of the sheets substantially along a single sheet path. More particularly, all sheets in the continuous stream of sheets pass through the nips between adjacent components.

38 Claims, 19 Drawing Sheets

(56) References Cited

U.S. PATENT DOCUMENTS

| | | | | |
|---|---|---|---|---|
| 4,061,325 | A | 12/1977 | Marcalus et al. | |
| 4,070,014 | A | 1/1978 | Takahashi | |
| 4,085,927 | A | 4/1978 | Müller | |
| 4,095,780 | A | 6/1978 | Gaspar et al. | |
| 4,190,241 | A | 2/1980 | Krueger | |
| 4,203,584 | A | 5/1980 | Smaw | |
| 4,205,836 | A | 6/1980 | Nystrand | |
| 4,254,947 | A | 3/1981 | Trogan | |
| 4,279,409 | A | 7/1981 | Pemberton | |
| 4,279,411 | A | 7/1981 | Nystrand | |
| 4,328,655 | A | 5/1982 | Spencer et al. | |
| 4,332,583 | A | 6/1982 | Stemmler et al. | |
| 4,403,981 | A | 9/1983 | Wüthrich | |
| 4,406,650 | A | 9/1983 | Felix | |
| 4,453,706 | A | 6/1984 | Bradley | |
| 4,475,730 | A | 10/1984 | Trogan | |
| 4,504,051 | A | 3/1985 | Bittner et al. | |
| 4,508,527 | A | 4/1985 | Uno et al. | |
| 4,521,209 | A | 6/1985 | DuFresne | |
| 4,530,694 | A | 7/1985 | Köbler et al. | |
| 4,666,139 | A | 5/1987 | Filewich | |
| 4,673,382 | A | 6/1987 | Buck et al. | |
| 4,691,908 | A | 9/1987 | Bradley | |
| 4,717,135 | A | 1/1988 | Hathaway | |
| 4,718,654 | A | 1/1988 | Ehlers | |
| 4,776,649 | A | 10/1988 | ten Wolde | |
| 4,778,165 | A | 10/1988 | Buck | |
| 4,854,932 | A | 8/1989 | Schlottke et al. | |
| 4,861,326 | A | 8/1989 | Kühner et al. | |
| 4,863,152 | A | 9/1989 | Milo | |
| 4,915,993 | A | 4/1990 | Ten Wolde | |
| 4,919,027 | A | 4/1990 | Littleton | |
| 4,952,432 | A | 8/1990 | Ten Wolde | |
| 5,030,193 | A | 7/1991 | Breton et al. | |
| 5,049,123 | A | 9/1991 | Breton et al. | |
| 5,064,179 | A | 11/1991 | Martin | |
| 5,110,101 | A | 5/1992 | Roth | |
| 5,147,273 | A | 9/1992 | Rottmann et al. | |
| 5,176,371 | A | 1/1993 | Rau et al. | |
| 5,205,808 | A | 4/1993 | Gebhardt | |
| 5,310,398 | A * | 5/1994 | Yoneyama | 493/430 |
| 5,956,926 | A | 9/1999 | O'Connor et al. | |
| 5,966,905 | A | 10/1999 | O'Connor et al. | |
| 5,989,174 | A | 11/1999 | Patrizio | |
| 6,090,467 | A | 7/2000 | Yip | |
| 6,296,601 | B1 | 10/2001 | Couturier | |
| 6,343,124 | B1 | 1/2002 | Munoz | |
| 6,402,132 | B1 | 6/2002 | Michaelis et al. | |
| 6,599,228 | B2 | 7/2003 | Hailey et al. | |
| 6,602,177 | B2 | 8/2003 | Muir | |
| 6,709,549 | B2 | 3/2004 | Berglund et al. | |
| 6,709,592 | B2 | 3/2004 | Van Groenestijn et al. | |
| 6,752,751 | B2 | 6/2004 | Jackson et al. | |
| 6,945,922 | B2 | 9/2005 | Baggot et al. | |
| 7,008,364 | B2 | 3/2006 | Ochsenbauer | |
| 7,081,080 | B2 | 7/2006 | Sosalla et al. | |
| 7,121,994 | B2 * | 10/2006 | Haasl | 493/442 |
| 7,219,890 | B2 | 5/2007 | White | |
| 7,264,583 | B2 | 9/2007 | Gelli et al. | |
| 7,306,554 | B2 | 12/2007 | Couturier et al. | |
| 7,329,221 | B2 | 2/2008 | Haasl et al. | |
| 7,351,190 | B2 | 4/2008 | Brunow et al. | |
| 7,402,130 | B1 | 7/2008 | Sjostedt et al. | |
| 7,407,161 | B2 | 8/2008 | White | |
| 7,442,157 | B2 | 10/2008 | De Matteis | |
| 7,452,321 | B2 * | 11/2008 | Kauppila | 493/418 |
| 7,458,927 | B2 | 12/2008 | Kauppila et al. | |
| 7,472,802 | B2 | 1/2009 | van Riel | |
| 7,517,309 | B2 | 4/2009 | De Matteis | |
| 7,717,839 | B2 | 5/2010 | Butterworth | |
| 7,758,486 | B2 | 7/2010 | Ochsenbauer | |
| 7,771,337 | B2 | 8/2010 | White et al. | |
| 2001/0014643 | A1 | 8/2001 | Sander | |
| 2005/0082332 | A1 * | 4/2005 | White | 226/95 |
| 2007/0082260 | A1 | 4/2007 | Slivar | |
| 2007/0082800 | A1 | 4/2007 | Kauppila | |
| 2007/0082801 | A1 | 4/2007 | Kauppila et al. | |
| 2007/0161487 | A1 | 7/2007 | Ryczek et al. | |
| 2007/0197365 | A1 * | 8/2007 | De Matteis | 493/433 |
| 2007/0203007 | A1 * | 8/2007 | De Matteis | 493/360 |
| 2007/0238596 | A1 | 10/2007 | Terhaag et al. | |
| 2008/0113855 | A1 | 5/2008 | Gooding, Jr. | |
| 2008/0200324 | A1 | 8/2008 | Morelli et al. | |
| 2009/0289407 | A1 * | 11/2009 | De Matteis | 270/39.07 |
| 2009/0298661 | A1 | 12/2009 | Grill | |
| 2011/0201486 | A1 | 8/2011 | Cline et al. | |
| 2011/0230324 | A1 | 9/2011 | De Matteis | |
| 2012/0165174 | A1 * | 6/2012 | Butterworth | 493/451 |
| 2012/0202670 | A1 | 8/2012 | De Matteis | |

FOREIGN PATENT DOCUMENTS

| | | | |
|---|---|---|---|
| EP | 0 376 754 | A2 | 7/1990 |
| WO | WO 91/06890 | A2 | 5/1991 |
| WO | WO 94/21464 | A1 | 9/1994 |
| WO | WO 2007/044701 | A2 | 4/2007 |
| WO | WO 2011/015893 | A1 | 2/2011 |

* cited by examiner

SINGLE PATH SINGLE WEB SINGLE-FOLD INTERFOLDER AND METHODS

FIELD OF THE INVENTION

This invention generally relates to folding a single web of material into a stream of interfolded sheet products, and more particularly to producing single-fold product from a single web of sheet material rather than from two separate webs.

BACKGROUND OF THE INVENTION

A variety of types of machines and processes exist for making folded sheet products such as paper hand towels, facial tissues, sheets of tin foil, and the like by producing stacks of interfolded sheets, or non-interfolded sheets, having a desired folded width.

In one form of a folded sheet, each sheet is folded only once to form double-panel sheets having two panels joined along a common fold line. It is desirable to interfold panels of successive sheets, at the same time as the sheets are being folded, by partially overlapping the individual sheets in the stack during the folding process. The overlapping and folding is carried out in such a manner that, with the interfolded stack loaded into a dispenser, when a sheet is pulled out of the dispenser at least one panel of the following sheet is also pulled out of the dispenser to facilitate pulling the next sheet from the dispenser.

The production of single-fold interfolded product has traditionally been performed with an interfolder that utilizes two separate webs from which two separate streams of sheets are formed. The streams of sheets are offset from one another such that the sheets from one stream overlap the sheets from the other stream by 50%. As such, each sheet overlaps two sheets from the other stream. Unfortunately, the use of two separate webs of material requires a significant duplication in components including two rolls of paper, two unwind stands, two web handling systems, two web embossers, two web cutoff systems, and two transfer paths for supplying the sheets to a single set of folding rolls that interfold the sheets.

The assignee of the instant application has also developed a system that will use only a single web material, but that passes sheets separated from the single web along two separate sheet flow paths to facilitate the proper orientation (see e.g. FIG. 3) of the sheets prior to passage through folding rolls of the system. Such a system is illustrated in U.S. patent application Ser. No. 12/977,393 entitled "Single Web Single-Fold Apparatus and Method," to Tad Butterworth, filed on Dec. 23, 2010.

Unfortunately, both of these systems are complex, expensive, and generally large. The present invention provides an improved system that provides the proper overlap for a single-fold interfolded stream of sheets while using a simple, more compact system by passing all sheets substantially along a single sheet flow path.

BRIEF SUMMARY OF THE INVENTION

Embodiments of the present invention provide new and improved folding apparatus methods for interfolding a continuous stream of sheets into a single-fold interfolded pattern of sheets while passing all of the sheets substantially along a single sheet path to substantially reduce the size, complexity, and expense of the apparatus and process.

In one embodiment, a folding apparatus for forming a pattern of single-folded interfolded sheets from a single web of material is provided. The folding apparatus includes a sheet cutoff system, a sheet overlap system and first and second counter-rotating folding rolls. The sheet cutoff system receives the single web of material and is configured to form a single stream of sheets. The sheets are substantially identical but may be referred to as alternating first and second sheets for simplicity as alternating sheets are handled differently along a common sheet flow path. The sheet overlap system is downstream from the sheet cutoff system operable in a single-folded interfolded mode configured to orient the stream of alternating first and second sheets into parallel first and second streams of sheets in an alternating overlap orientation. The first stream of sheets is formed by the first sheets and the second stream of sheets is formed by the second sheets. The first and second counter-rotating folding rolls form a folding nip therebetween for passage of the parallel first and second streams of sheets to produce the single-folded interfolded sheets.

The sheet cutoff system, sheet overlap system and first and second counter-rotating folding rolls define a sheet flow path. All sheets pass substantially along the sheet flow path from the sheet cutoff system through the folding nip. In a more particular embodiment, all sheets pass through the same nips between adjacent components when traveling from the sheet cutoff system through the folding nip.

In one embodiment, the alternating overlap orientation has each first sheet overlapped with a tail end of a downstream second sheet downstream from the first sheet and a leading end of an upstream second sheet upstream from the first sheet. The tail end of downstream second sheet and the leading end of the upstream second sheet are positioned on a same side of the overlapping first sheet. The tail end of the downstream second sheet is positioned adjacent the leading end of the upstream second sheet.

In one embodiment, the sheet overlap system includes a lap roll and a tail roll. The lap roll has a lap roll surface speed. The lap roll operably receives, i.e. directly or indirectly, all sheets from the sheet cutoff system. The first and second counter-rotating folding rolls have a folding roll surface speed that is less than the lap roll surface speed, preferably 50% less. The lap roll and the first counter-rotating folding rolls form an overlap nip therebetween. The tail roll is adjacent the lap roll and forms a tail lifting nip therebetween. The tail lifting nip is upstream from the overlap nip. The tail roll lifts, and thereby controls, an upstream tail end of each first sheet off of the lap roll after a downstream leading end of that first sheet has been transferred from the lap roll to the first folding roll.

In a more particular embodiment, the lap roll retains control of an upstream tail end of each second sheet until after the lap roll has transferred the downstream leading end of a successive upstream first sheet to the first folding roll.

In an even more particular embodiment, the lap roll retains control of the upstream tail end of each second sheet after the upstream tail end has passed through the overlap nip. This allows for the tail end of the second sheets to overlap the leading end of the successive upstream first sheets.

In one embodiment, after release of the upstream tail end of each second sheet by the lap roll, the upstream tail end of each second sheet overlaps the downstream leading end of the successive upstream first sheet. The successive first sheet is radially interposed between the second sheet and the first folding roll.

In one embodiment, the tail roll retains control of the upstream tail end of each first sheet until after the downstream leading end of each successive upstream second sheet passes through the tail lifting nip.

In one embodiment, the tail roll forms a void between the upstream tail end of each first sheet the tail roll controls and the lap roll. The lap roll advancing a downstream leading end of the successive upstream second sheet into the void prior to the upstream tail end of the first sheet being released. The upstream tail end of each first sheet overlaps the downstream leading end of the successive upstream second sheet when released from the tail roll. The successive second sheet being radially interposed between the first sheet and the lap roll.

In one embodiment, the lap roll includes a first sheet control portion and a second sheet control portion. The first sheet control portion receives and controls first sheets from the sheet cutoff system. The second sheet control portion receives and controls second sheets from the sheet cutoff system. The first sheet control portion includes a first sheet leading end control mechanism actionable to selectively grip the downstream leading end of first sheets and actionable to selectively release the downstream leading end of first sheets. The second sheet control portion includes a second sheet leading end control mechanism actionable to selectively grip the downstream leading end of second sheets and actionable to selectively release the downstream leading end of second sheets and a second sheet tail end control mechanism actionable to selectively grip the upstream tail end of second sheets and actionable to selectively release the upstream tail end of second sheets. The second sheet tail end control mechanism grips the upstream tail end of each second sheet until after the leading end control mechanism has released the downstream leading end of the successive upstream first sheet.

In one embodiment, the first sheet leading end control mechanism is at least one vacuum port; the second sheet leading end control mechanism is at least one vacuum port; and the second sheet tail end control mechanism is at least one vacuum port.

In one embodiment, the second sheet control portion includes at least one second sheet intermediate section control mechanism that is angularly positioned between the second sheet leading end control mechanism and the second sheet tail end control mechanism.

In one embodiment, the first sheet leading end control mechanism is at least one vacuum port; the second sheet leading end control mechanism is at least one vacuum port; the second sheet tail end control mechanism is at least one vacuum port; and the at least one second sheet intermediate section control mechanism is at least one vacuum port.

In one embodiment, the sheet overlap system includes a lap roll, a tail roll, and a transfer roll. The lap roll has a lap roll surface speed. The lap roll operably receives all sheets from the sheet cutoff system. The transfer roll has a transfer roll surface speed that is less than the lap roll surface speed, the lap roll and the transfer roll form an overlap nip therebetween, the tail roll being adjacent the lap roll and upstream from the overlap nip, the tail roll lifts an upstream tail end of each first sheet off of the lap roll after a downstream leading end of the first sheet has been transferred from the lap roll to the transfer roll, the overlap nip forming part of the sheet flow path along which all sheets substantially travel and being upstream of the first and second counter-rotating folding rolls.

In one embodiment, the lap roll retains control of the upstream tail end of each second sheet until after the lap roll has transferred the downstream leading end of a successive upstream first sheet to the transfer roll.

In one embodiment, the sheet overlap system includes a transfer roll, a lifting roll, first and second retarding rolls, and first and second sheet guides. The transfer roll operably receives all sheets from the sheet cutoff system, the transfer roll having a transfer roll surface speed. The lifting roll is adjacent the transfer roll forming a directing nip. The lifting roll has a lifting roll surface speed substantially equal to the transfer roll surface speed. The first and second retarding rolls form a retarding nip downstream from the transfer roll and upstream from the folding nip. The first and second retarding rolls have a retarding roll surface speed that is less than the transfer roll surface speed. The first and second sheet guides are upstream from and forming an inlet to the retarding nip. The lifting roll lifts a downstream leading end of each second sheet off of the transfer roll and transfers the downstream leading end of each second sheet to the second sheet guide. The transfer roll transfers a downstream leading end of each first sheet to the first sheet guide.

In one embodiment, a length each sheet travels along the corresponding first or second sheet guide to the corresponding retarding roll is substantially equal to a length of the sheet.

In one embodiment, the transfer roll surface speed is twice as fast as the retarding roll surface speed.

In one embodiment, the lifting roll retains control of an upstream tail end of each second sheet until the downstream leading end of a successive upstream first sheet has been transferred to the first sheet guide by the transfer roll.

In one embodiment, the downstream leading end of each first sheet is guided to the retarding nip between the first sheet guide and a downstream second sheet that is being guided by the second sheet guide. The downstream leading end of each second sheet is guided to the retarding nip between the second sheet guide and a downstream first sheet that is being guided by the first sheet guide.

Method of forming a pattern of single-folded sheets from a single web of material while passing all sheets along substantially a single sheet flow path.

In one method, the method includes feeding the single web of material to a sheet cutoff system. The method includes cutting the single web of material with the sheet cutoff system to form a single stream of alternating first and second sheets. The method includes feeding the single stream of sheets to a sheet overlap system downstream from the sheet cutoff system. The method includes orienting the single stream of sheets into parallel first and second streams of sheets in an alternating overlap orientation using the overlap system. The method includes directing the parallel first and second streams through a folding nip formed between first and second counter-rotating folding rolls to produce the single-folded interfolded sheets. The sheet cutoff system, sheet overlap system and first and second counter-rotating folding rolls define a sheet flow path. All sheets travel substantially along the sheet flow path from the sheet cutoff system through the folding nip.

In one implementation, the step of orienting includes: receiving each sheet by a lap roll having a lap roll surface speed; transferring a downstream leading end of each first sheet to the first folding roll having a folding roll surface speed that is less than the lap roll surface speed; and lifting, with a tail roll, an upstream tail end of each first sheet off of the lap roll while the downstream leading end of the first sheet is controlled by the folding roll.

In one embodiment, the step of orienting includes: retaining control of an upstream tail end of each second sheet, with the lap roll, until after the lap roll has transferred the downstream leading end of the successive upstream first sheet to the first folding roll; and releasing control of the upstream tail end of each second sheet, by the lap roll, after the lap roll has transferred the downstream leading end of each successive upstream first sheet to the first folding roll.

In one embodiment, the step of orienting includes retaining control of the upstream tail end of each second sheet, by the lap roll, after the upstream tail end of each second sheet has passed through an overlap nip formed between the lap roll and the first folding roll.

In one embodiment, the step of orienting includes releasing the upstream tail end of each second sheet by the lap roll. After being released, the upstream tail end of each second sheet overlaps the downstream leading end of the successive upstream first sheet, which has been transferred to the first folding roll. Additionally, the successive upstream first sheet is radially interposed between the second sheet and the first folding roll.

In one embodiment, the step of lifting includes retaining control of the upstream tail end of each first sheet, with the tail roll, until after the downstream leading end of each successive upstream second sheet passes through a tail lifting nip formed between the tail roll and the lap roll.

In one embodiment, the sheets are controlled by the lap roll, tail roll and first and second counter-rotating folding rolls using vacuum or vacuum ports that are operably coupled to valve arrangements configured to selectively turn on and turn off vacuum.

In one embodiment, the step of retaining control of the upstream tail end of each second sheet includes forming a void between the first folding roll and the second sheet. The method further includes advancing the downstream leading end of the successive upstream first sheet with the first folding roll into the void.

In one embodiment, the lap roll does not transfer the sheets directly to a folding roll. Instead, in one method, the step of orienting includes: receiving each sheet by a lap roll having a lap roll surface speed; transferring each sheet to a transfer roll having a transfer roll surface speed that is less than the lap roll surface speed; and lifting, with a tail roll, an upstream tail end of each first sheet off of the lap roll after a downstream leading end of the first sheet has been transferred from the lap roll to the transfer roll.

In one implementation, the step of orienting includes: retaining control of an upstream tail end of each second sheet, with the lap roll, until after the lap roll has transferred the downstream leading end of the successive upstream first sheet to the transfer roll; and releasing control of the upstream tail end of each second sheet, by the lap roll, after the lap roll has transferred the downstream leading end of each successive upstream first sheet to the transfer roll.

In one implementation, the step of orienting includes retaining control of the upstream tail end of each second sheet, by the lap roll, after the upstream tail end of each second sheet has passed through an overlap nip formed between the lap roll and the transfer roll.

In a further implementation, the step of orienting includes receiving each sheet by a transfer roll of the sheet overlap system having a transfer roll surface speed. The step of orienting includes transferring, with the transfer roll, a downstream leading end of each first sheet to a first sheet guide downstream from the transfer roll and upstream from the folding nip. The step of orienting includes lifting, with a lifting roll, a downstream lead end of each second sheet off of the transfer roll. The lifting roll having a lifting roll surface speed substantially equal to the transfer roll surface speed. The step of orienting includes transferring, with the lifting roll, the downstream leading end of each second sheet to a second sheet guide downstream from the transfer roll and the lifting roll. The step of orienting includes retarding, operably, a speed of the sheets along the sheet flow path with first and second retarding rolls forming a retarding nip downstream from the transfer roll and upstream from the folding nip. The first and second retarding rolls have a retarding roll surface speed that is less than the transfer roll surface speed.

In one embodiment, a length each sheet travels down the corresponding first or second sheet guide to the corresponding retarding roll is substantially equal to a length of the sheet.

In one embodiment, the transfer roll surface speed is twice as fast as the retarding roll surface speed. The step of retarding includes passing a downstream half of a first sheet through the retarding nip substantially aligned with an upstream half of a downstream second sheet and passing an upstream half of the first sheet through the retarding nip substantially aligned with a downstream half of an upstream second sheet.

In one embodiment, the step of orienting includes retaining control of an upstream tail end of each second sheet, with the lifting roll, until a downstream leading end of a successive upstream first sheet has been transferred to the first sheet guide by the transfer roll.

In one embodiment, the step of orienting includes: guiding a downstream leading end of each first sheet to the retarding nip between the first sheet guide and a second sheet that is being guided by the second sheet guide; and guiding a downstream leading end of each second sheet to the retarding nip between the second sheet guide and a first sheet that is being guided by the first sheet guide.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
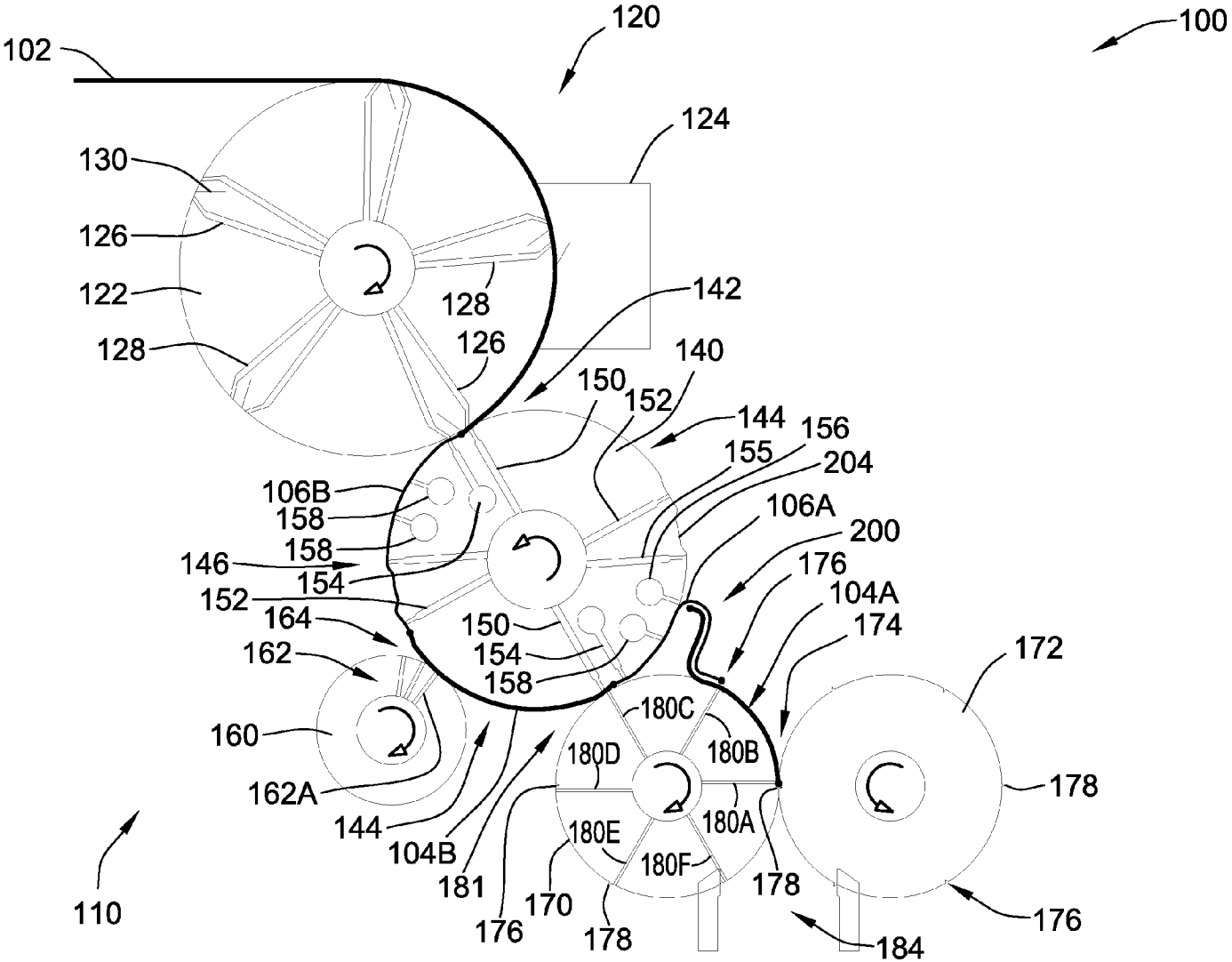
FIG. 1 is a simplified schematic illustration of a portion of a folding apparatus according to a first embodiment of the present invention.

FIG. 1 is a partial schematic illustration of a folding apparatus 100 according to an embodiment of the present invention. The folding apparatus 100 is configured to form a continuous stream of single-folded interfolded sheets from a single continuous web of material 102. A continuous stream of single-folded interfolded sheets is illustrated schematically in FIG. 2. The sheets are generally identified by reference numerals 104 and 106. This folding apparatus 100 is configured such that all of the sheets travel substantially along a single sheet flow path rather than a plurality of parallel flow paths as in prior art single-fold interfold devices.

Figure 3:
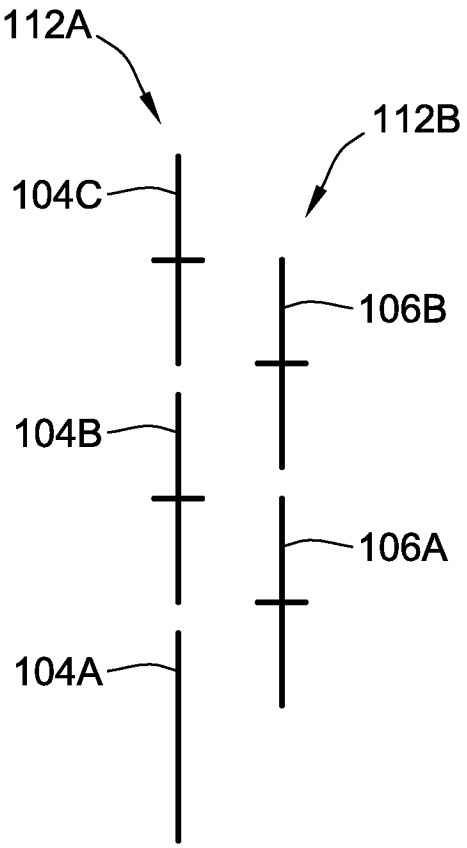
FIG. 3 is a simplified schematic illustration of the overlap orientation necessary for sheets to enter a pair of counter-rotating folding rolls to produce the stream of single-fold interfolded sheets of FIG. 2.
Figure 2:
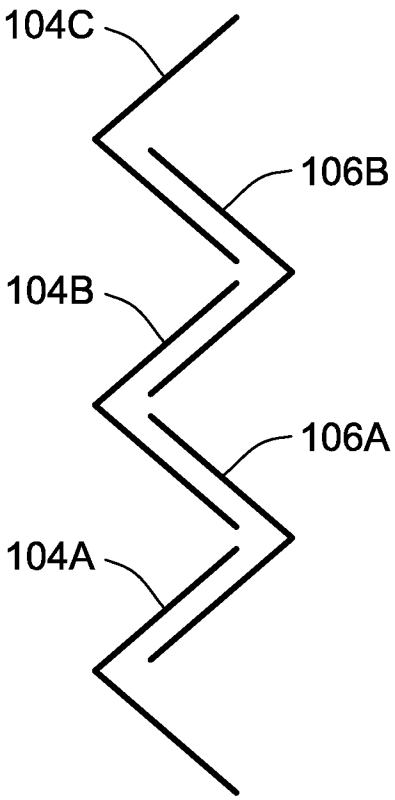
FIG. 2 is a simplified schematic illustration of a stream of single-fold interfolded sheets of product formed by folding apparatuses according to embodiments of the present invention.

The folding apparatus 100 includes a sheet overlap system 110 configured to arrange a continuous stream of sheets into an alternating overlap orientation illustrated in FIG. 3 which is necessary to form the stream of single-folded interfolded sheets illustrated in FIG. 2. The pattern illustrated in FIG. 3 includes a pair of parallel first and second streams of sheets 112A, 112B formed by sheets 104 and 106, respectively. "Alternating overlap orientation" as used herein shall not be broad enough to include overlapping in a shingled overlapping orientation.

The illustrated embodiment includes a sheet cutoff system 120 upstream of the sheet overlap system 110 for producing the continuous stream of sheets 104, 106 from the continuous web of material 102. The sheet cutoff system 120 includes a knife roll 122 that cooperates with a knife anvil 124 to form the continuous stream of sheets 104, 106. While all sheets 104, 106 in the stream will be substantially identical, i.e. having a same length, for better understanding of the operation of the system 100, the stream of sheets will be considered to have a single stream of alternating first sheets 104 and second sheets 106. When exiting the sheet cutoff system 120, each first sheet 104 is interposed along the sheet flow path between a pair of second sheets 106 and each second sheet 106 is similarly interposed along the sheet flow path between a pair of first sheets 104. As such, every other sheet is a first sheet 104 and every successive sheet after a first sheet 104 is a second sheet 106. In various ones of the figures, first sheets 104 have a different line weight than second sheets 106. This is merely done for illustrative purposes to better distinguish between the different sheets. Further, where adjacent first and second sheets 104, 106 overlap, a gap may be illustrated between the adjacent sheets 104, 106 for illustrative purposes. However, this gap may not be present during actual operation.

While a knife roll 122 and knife anvil 124 are illustrated, other systems for cutting the continuous web of material 102 into successive sheets 104, 106 can be used. For instance, the knife roll 122 could cooperate with a second roll rather than the knife anvil to cut the continuous web of material.

The knife roll 124 includes a plurality of sheet control mechanism in the form of a plurality of downstream vacuum ports 126 and upstream vacuum ports 128 positioned adjacent to a plurality of cutting knifes 130 for vacuum attaching a sheet 104, 106 to the knife roll 124 after the sheet 104, 106 has been cut from the continuous web of material 102. Vacuum pressure can be selectively turned on and off to selectively grip or release portions of the sheets 104, 106 to allow for proper transfer of the sheets 104, 106 from the knife roll 122.

The sheet overlap system 110 is downstream from the sheet cutoff system 120 and is configured to direct the first sheets 104 into the first stream of sheets 112A and the second sheets 106 into the second stream of sheets 112B (see FIG. 3). As will be described more fully, even though the sheets 104, 106 will form two separate streams 112A, 112B, all sheets 104, 106 will flow substantially along a single sheet flow path because all sheets 104, 106 will pass between the same nips or gaps formed between adjacent components.

A lap roll 140 directly receives each sheet 104, 106 formed by the sheet cutoff system 120 on an outer periphery thereof. However, other embodiments could include a transfer roll or other mechanisms interposed between the lap roll 140 and the sheet cutoff system 120.

The lap roll 140 and the knife roll 122 form a nip 142 therebetween where the sheets 104, 106 are operably transferred from the knife roll 122 to the lap roll 140. The knife roll 122 and lap roll 140 typically have a surface speed that is substantially identical.

The lap roll 140 includes a plurality of angularly alternating first sheet control portions 144 and second sheet control portions 146. The first sheet control portions 144 receive the first sheets 104 from the knife roll 122 and secure the first sheets 104 to the outer periphery of the lap roll 140. The second sheet control portions 146 receive the second sheets 106 from the knife roll 122 and secure the second sheets 106 to the outer periphery of the lap roll.

The first sheet control portions 144 include, at a minimum, a first sheet leading end control mechanism 150 that operably selectively grips and releases a leading end of each first sheet. In the illustrated embodiment, the first sheet leading end control mechanisms 150 are in the form of vacuum ports that are selectively connected to a source of vacuum to grip and release a corresponding first sheet 104 proximate a leading end thereof, i.e. a downstream end. In some embodiments, the first sheet control portions 144 could include a first sheet tail end control mechanism that operably selectively grips and releases a tail end of each first sheet 104.

The second sheet control portions 146 include, at a minimum, a second sheet leading end control mechanism 152 that operably selectively grips and releases a leading end of each second sheet 106 and a second sheet tail end control mechanism 154 that operably selectively grips and releases a tail end of each second sheet 106. In the illustrated embodiment, the second sheet leading end and tail end control mechanisms 152, 154 are in the form of vacuum ports that are selectively connected to a source of vacuum to grip and release the corresponding portions of a second sheet 106.

The second sheet control portions 146 in the illustrated embodiment further include a plurality of second sheet intermediate section control mechanisms 155, 156, 158 that are angular interposed between the second sheet leading and tail end control mechanisms 152, 154 that provide increased control over the intermediate sections of the length of the second sheets 106. Again, these control mechanisms 155, 156, 158 are illustrated in the form of vacuum ports that can be selectively opened to a vacuum for selectively gripping and releasing a corresponding portion of a second sheets 106.

Adjacent the lap roll 140 is a lifting roll in the form of tail roll 160 that selectively grips, via vacuum in the illustrated embodiment, and lifts the tail end of a first sheet 104 from the outer periphery of the lap roll 140 to facilitate downstream overlapping of adjacent first and second sheets 104, 106 into the pattern illustrated in FIG. 3. The tail roll 160 and lap roll 140 have substantially an identical surface speed.

The tail roll 160 includes a tail end control portion 162 that selectively grips and lifts the tail end of first sheets 104 from the outer periphery of the lap roll 140. The tail end control portion 162 in the illustrated embodiment is provided by a control mechanism in the form of a plurality of vacuum ports that are selectively opened to a vacuum to grip the tail end of the first sheets 104 as the first sheets 104 pass through a tail lifting nip 164 formed between the lap roll 140 and tail roll 160. The tail roll 160 is configured and controlled such that vacuum pressure is not provided to the second sheets 106 such that the second sheets 106, and particularly the tail ends thereof, remain controlled by the lap roll 140 after passing through the tail lifting nip 164 and are not lifted off of the outer periphery of the lap roll 140.

The system includes a roll downstream from the lap roll 140 that cooperates with the lap roll to assist, at least in part, in properly overlapping the first and second sheets 104, 106 for downstream folding operations. This roll may be generically referred to as a "receiving roll" as it receives all sheets 104, 106, by direct transfer, from the lap roll 140. As well as assisting in overlapping the first and second sheets 104, 106, the receiving roll may perform additional functions as well. The receiving roll and the lap roll 140 will form an overlap nip 181 therebetween through which all sheets 104, 106 will pass. The overlap nip 181 is downstream from the overlap nip 164.

In the embodiment of FIG. 1, the receiving roll takes the form of a first folding roll 170 of a pair of first and second counter-rotating folding rolls 170, 172. As such, in this embodiment, the receiving roll also performs folding roll functions for folding the sheets 104, 106.

The first and second counter-rotating folding rolls 170, 172 are downstream from the lap roll 140 and form a folding nip 174 therebetween. In the illustrated embodiment, each folding roll 170, 172 includes a plurality of grippers 176 and tuckers 178 for selectively gripping and folding the overlapped parallel first and second streams of sheets as they pass through the folding nip 174 as is generally well known in the art to form a stream of single-folded interfolded sheets (such as illustrated in FIG. 2). As is well known, the tuckers 176 from one roll generally align with the grippers 178 from the other roll to fold the sheets. However, alternative folding rolls could use other structures other than tuckers and grippers to create the folds.

The first counter-rotating folding roll 170 also includes a plurality of sheet control mechanisms 180 in the form of vacuum ports that assist in transferring and securing the parallel streams of sheets 112A, 112B to the outer periphery thereof from the lap roll 140 proximate an overlap nip 181. The overlap nip 181 is formed between the first folding roll 170 and the lap roll 140. To facilitate properly orienting the sheets 104, 106 in the overlapped pattern illustrated in FIG. 3, the first folding roll 170, to which the sheets 104, 106 are operably transferred from the lap roll 140, has a folding roll surface speed that is slower than the lap roll surface speed. When forming single-folded interfolded sheets with a 50% overlap as illustrated in FIGS. 2 and 3, the lap roll surface speed is twice the folding roll surface speed.

Downstream from the folding nip 174 is a sheet stacking area 184 that receives the stream of interfolded sheets. The sheets will be stacked and separated into individual discrete stacks of sheets as is well known in the art.

The folding apparatus 100 generally defines a single flow path that all of the sheets travel along when traveling from the sheet cutoff system 120 to the sheet stacking area 184. While alternating sheets, i.e. first and second sheets, may travel along a slightly different orientation along the flow path from the sheet cutoff system 120 to the sheet stacking area 184 all of the sheets will pass through all of the same nips between adjacent components. As such, if one sheet in the stream of sheet passes between two adjacent components, all other sheets will also pass between the same two adjacent components. This is unlike prior art systems where alternating sheets travel along substantially different flow paths and between one or more different nips.

With the general structure of the folding apparatus 100 described, the operation of the device to form a stream of single-fold interfolded sheets will be described.

The continuous web of material 102 enters the sheet cutoff system 120 where it is converted into a stream of successive first and second sheets 104, 106. Again, all sheets (i.e. the first and second sheets 104, 106) are substantially identical but merely identified differently for purposes of explanation.

The first sheets 104 are transferred to the first sheet control portions 144 and the second sheets 106 are transferred to the second sheet control portions 146 of the lap roll using the control mechanisms (i.e. vacuum ports in the illustrated embodiment) of the knife roll 122 and lap roll 140. Notably, each sheet will pass through the nip 142 formed between the lap roll 140 and the knife roll 122.

As the sheets 104, 106 travel downstream, the sheets 104, 106 pass through tail end lifting nip 164. As the first sheets 104 pass through the tail end lifting nip 164 vacuum is supplied to the tail end control portion 162 to engage the tail end of the first sheets 104 and to lift the tail end off of the outer periphery of the lap roll 140 and particularly the first sheet control portion 144 thereof. Again, as each second sheet 106 passes through the tail end lifting nip 164, the tail end control portion 162 does not align with the second sheets 106 and thus vacuum is not applied to the second sheets 106 as they pass through the tail end lifting nip 164.

The sheets 104, 106 are carried by the lap roll 140 to the first counter-rotating folding roll 170 and are operably transferred thereto by coordinated activation and deactivation of the sheet control mechanisms 150, 152, 154, 155, 156, 158 of the lap roll 140 and the sheet control mechanisms 180 of the first folding roll 170.

Because the lap roll surface speed is twice as fast as the folding roll surface speed, any sheet 104, 106 or any portion of a sheet 104, 106 that is gripped and controlled by the lap roll 140 will travel at a speed of twice as fast as any sheet 104, 106 or any portion of a sheet 104, 106 that is gripped and controlled by the first folding roll 170. This allows for the lap roll 140 and the first folding roll 170 to operably overlap successive sheets 104, 106 in the stream of sheets to form the pattern illustrated in FIG. 3.

In FIG. 1, a downstream first sheet 104A has been transferred to the first folding roll 170 with its leading edge adjacent a tucker 178 and gripped by sheet control mechanism 180A of the first folding roll 170. The middle of the downstream first sheet 104A is held against the outer periphery of the first folding roll 170 with sheet control mechanism 180B proximate gripper 176.

A leading end of downstream second sheet 106A has been transferred to the first folding roll 170 with its leading edge adjacent gripper 176 and gripped by sheet control mechanism 180B of the first folding roll 170. The leading end of the downstream second sheet 106A is located on top of and overlaps by approximately 50% a tail end of the downstream first sheet 104A. The tail end of the downstream first sheet 104A is interposed between the first folding roll 170 and the leading end of the downstream second sheet 106A.

Notably, the downstream second sheet 106A was the sheet that immediately followed downstream first sheet 104A in the stream of sheets.

An intermediate section of the downstream second sheet 106A has passed through the overlap nip 181 and remains controlled by the lap roll 140 and particularly by second sheet intermediate section control mechanisms 156, 158. The tail end of the downstream second sheet 106A is gripped and controlled by the lap roll with second sheet tail end control mechanism 154.

Because the lap roll surface speed is greater than the folding roll surface speed, the tail end of the downstream second sheet 106A is traveling at a faster speed than the leading end of the downstream second sheet 106A that is gripped and controlled by the first folding roll 170 and particularly sheet control mechanism 180B. As such, intermediate portion of the downstream second sheet 106A is lifted by the lap roll 140 forming a bubble 200 with the downstream second sheet 106A. The tail end of the downstream first sheet 104A is also lifted with the downstream second sheet 106A.

The leading end of an upstream first sheet 104B is being vacuum transferred from the lap roll 140, and particularly the first sheet leading end control mechanism 150 to the first folding roll 170, and particularly sheet control mechanism 180C.

The tail end of upstream first sheet 104B is being lifted away from the lap roll 140 by tail roll 160 and particularly a first vacuum port of the tail end control portion 162.

Figure 4:
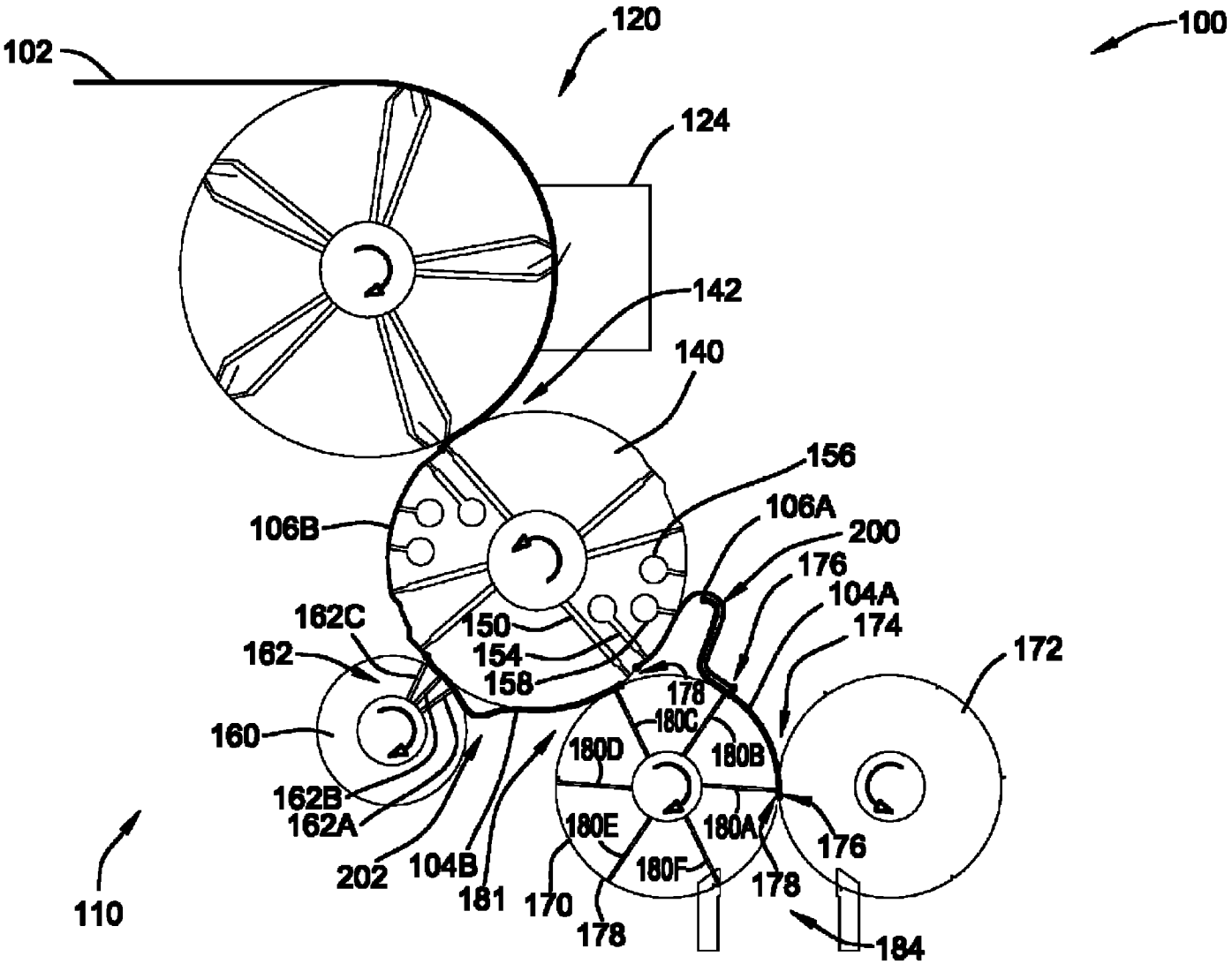
FIGS. 4-14 are schematic illustrations of the folding apparatus of FIG. 1 in various operational positions illustrating the operation of the folding apparatus.

With reference to FIG. 4, the system has indexed forward slightly. The leading end of the downstream first sheet 104A is transferred from the tucker 178 of the first folding roll 170 to the gripper 176 of the second folding roll 172. It should be noted that the current illustrations illustrate the system as the initial sheets from the stream of sheets pass through the system. After the initial set-up, the downstream first sheet 104A would be overlapped with another second sheet, unlike the illustrated figures. As such, during normal operation, i.e. non-start-up operation, this additional second sheet would also be transferred from the tucker 178 of the first folding roll 170 to the gripper 176 of the second folding roll 172 to form a fold therein.

The tail end of the downstream second sheet 106A has fully passed through the overlap nip 181 and remains controlled and gripped by the lap roll 140, and particularly second sheet tail end control mechanism 154. The bubble/void 200 formed by the downstream second sheet 106A continues to build.

The leading end of the upstream first sheet 104B is passing through the overlap nip 181 and has been transferred from the lap roll 140 to the first folding roll 170 proximate a tucker 178. The leading end of the upstream first sheet 104B is gripped and controlled by sheet control mechanism 180C of the first folding roll 170. Further, this portion of the upstream first sheet 104B is no longer gripped by first sheet leading end control mechanism 150 and the vacuum has been turned off thereto by proper valving.

As such, the speed of the leading end of the upstream first sheet 104B is reduced to the folding roll surface speed which is half the lap roll surface speed and the tail roll surface speed. The tail end of the upstream first sheet 104B is gripped and controlled by the tail end control portion 162 of the tail roll 160, and particularly the first and second vacuum ports 162A, 162B. As such, the tail end of the upstream first sheet 104B is traveling at a faster rate than the leading end of the upstream first sheet 104B. This causes a bubble/void 202 to form in the upstream first sheet 104B such that the tail end of the upstream first sheet 104B lifts away from the outer periphery of the lap roll 140.

Figure 5:
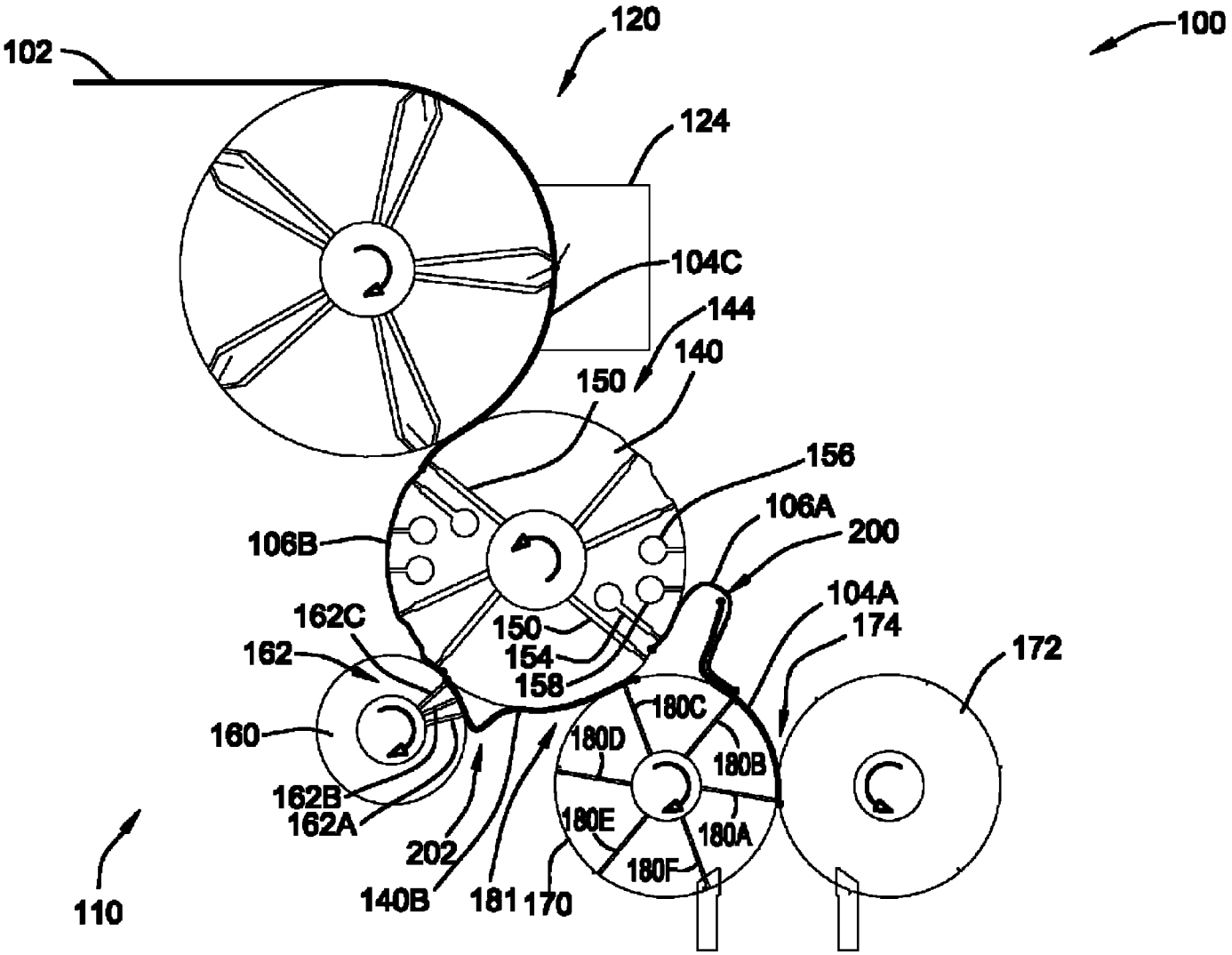

With reference to FIG. 5, the system has indexed forward slightly from its position in FIG. 4. The configuration of the various rolls 140, 160, 170, 172 and corresponding portion of sheets 104A, 104B, 106A, 106B is similar as well. However, at this point, the third vacuum port 162C of the tail end control portion 162 of the tail roll 160 is gripping the tail end of the upstream first sheet 104B. Both bubbles/voids 200 and 202 have increased in size.

Additionally, a third first sheet 104C has been formed from the single web of material 102 by the cutoff system 120.

Figure 6:
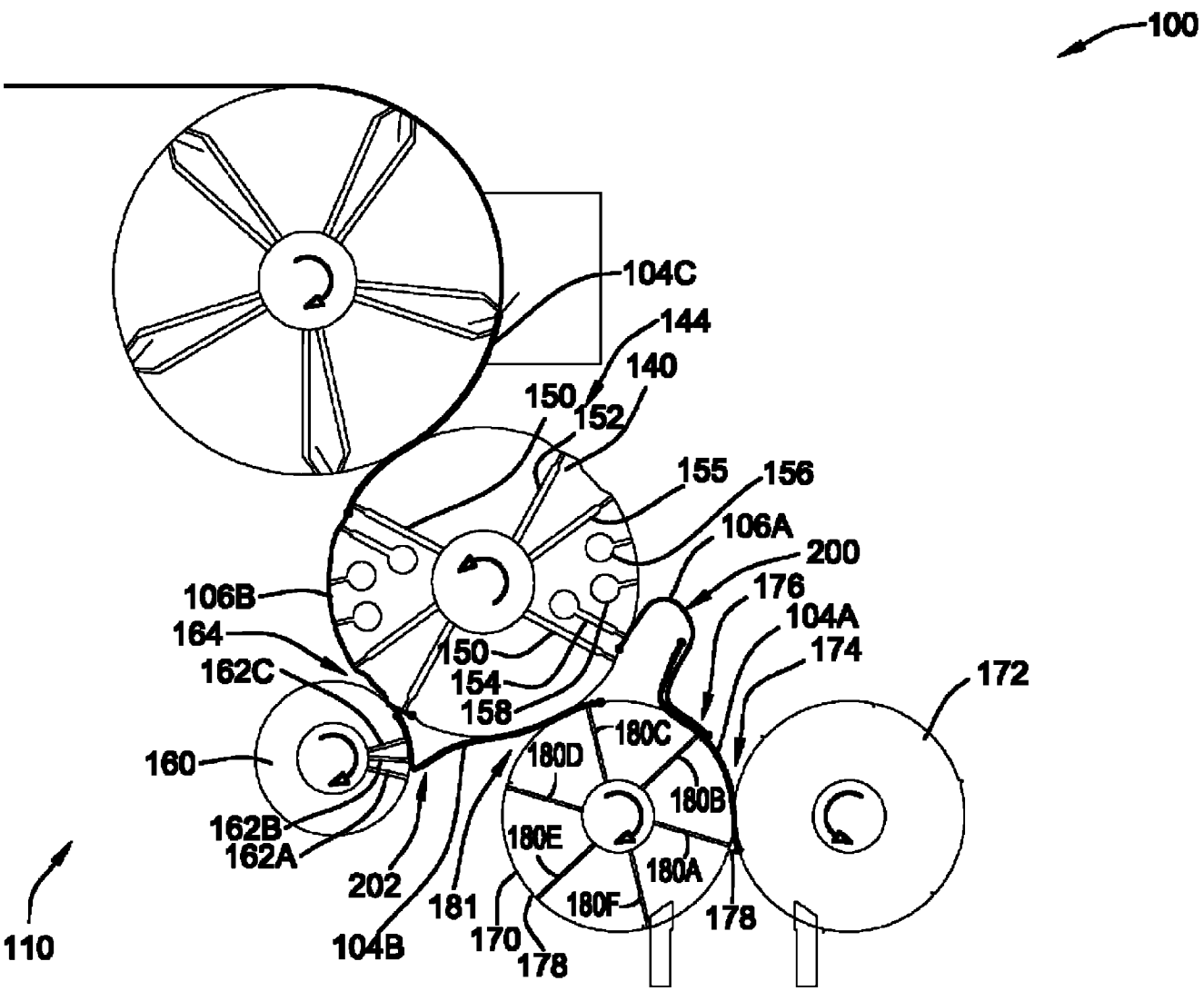

With reference to FIG. 6, the system has indexed forward from its position in FIG. 5.

In this position, only the second sheet tail end control mechanism 152 grips the downstream second sheet 106A proximate the tail end thereof. The second sheet intermediate section control mechanism 158 no longer grips the downstream second sheet 106A and thus vacuum to the two second sheet intermediate section control mechanisms 156, 158 has been turned off by internal valving of the lap roll 140. Again, the void/bubble 200 has grown even further.

The leading end of the upstream first sheet 104B has passed through the overlap nip 181 and is traveling further into void/bubble 200 and advancing underneath the tail end of the downstream second sheet 106A.

The tail end of upstream first sheet 104B has been released by the first vacuum port 162A but remains gripped by the second and third vacuum ports 162B, 162C and the void/bubble 202 has grown further. The tail end of the upstream first sheet 104B has traveled completely through the tail lifting nip 164.

The leading end of the upstream second sheet 106B has passed through the tail lifting nip 164 and is advancing over the tail end of the upstream first sheet 104B.

Figure 7:
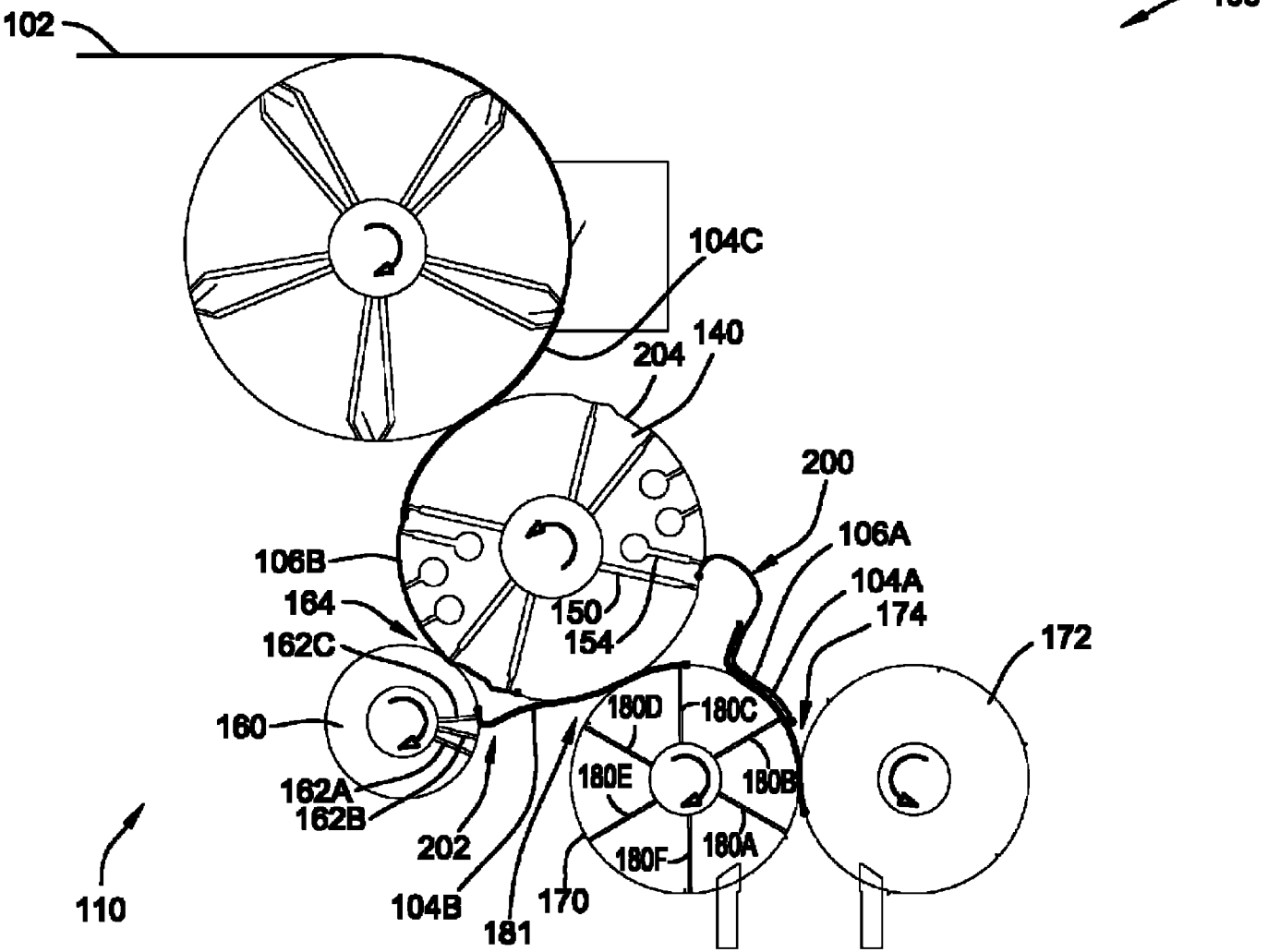

With reference to FIG. 7, the system has indexed forward from its position in FIG. 6.

In this position, the tail end of the downstream second sheet 106A is still controlled by the lap roll 140.

The leading end of the upstream second sheet 106B is advancing farther into the void/bubble 202 formed by the tail end of the upstream first sheet 104B and farther over the tail end of the upstream first sheet 104B. The tail end of the upstream first sheet 104B is gripped only by the third vacuum port 162C and vacuum has been turned off to the second vacuum port 162B by appropriate valving.

Figure 8:
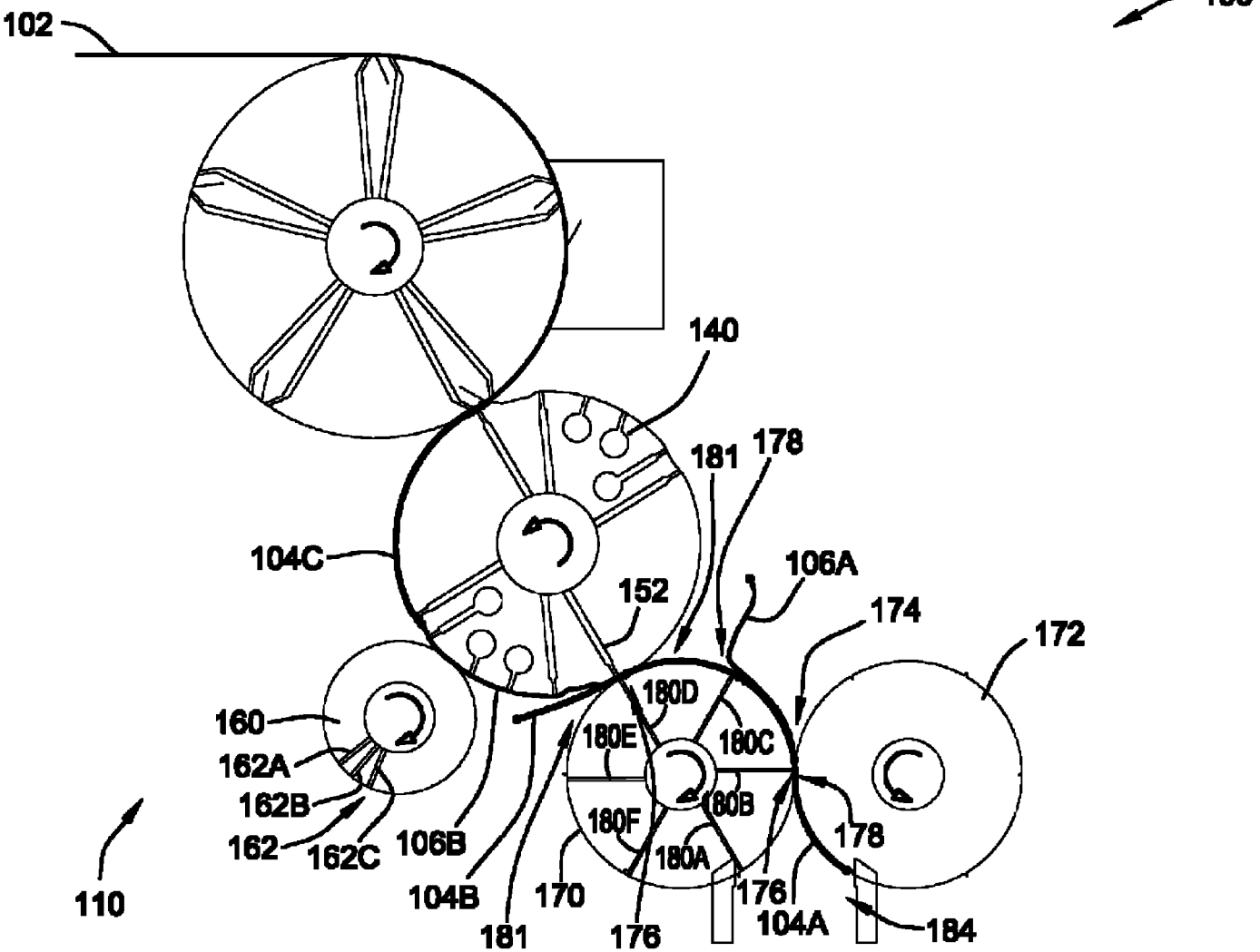

With reference to FIG. 8, the system has indexed forward from its position in FIG. 7.

In this position, the leading end of the downstream first sheet 104A is advancing into the stacking area 184 downstream from the first and second counter-rotating folding rolls 170, 172. The leading end of the downstream first sheet 104A is dropped by the corresponding gripper 176 of the second folding roll 172 in stacking area 184.

The intermediate section of the downstream first sheet 104A and corresponding leading edge of the downstream second sheet 106A are passing through the folding nip 174. The gripper 176 of the first folding roll 170 and tucker 178 of the second folding roll 172 form a fold in the downstream first sheet 104A with the leading edge of the downstream second sheet 106A positioned substantially in the fold. More particularly, the gripper 176 of the first folding roll 170 closes to form the fold in the downstream first sheet 104A.

The tail end of the downstream second sheet 106A has been released by the second sheet tail end control mechanism 154 of the lap roll 140. The tail end of the upstream first sheet 104B has been released by the third vacuum port 162 of the tail roll 160. The tail roll 160 is not gripping or lifting any portion of any sheet 104, 106 at this time, and particularly the tail end of the upstream second sheet 106B.

The tail ends of the downstream first and second sheets 104A, 106A transition towards the first folding roll 170 to complete the 50% overlap between the tail end of the downstream second sheet 106A and the upstream first sheet 104B. The tail end of downstream first sheet 104A becomes positioned adjacent to the leading end of the upstream first sheet 104B with the middle of the downstream second sheet 106A overlapping the two end portions of the first sheets 104A, 104B.

Similarly, the 50% overlap between the leading end of the upstream second sheet 106B and the tail end of the upstream first sheet 104B is substantially completed.

The leading end of the upstream second sheet 106B is passing through the overlap nip 181 and is transferred to the first folding roll 170 from the lap roll 140. The leading end of the upstream second sheet 106B is positioned on top of the intermediate portion of the upstream first sheet 104B. The leading end of the upstream second sheet 106B is gripped with the intermediate portion of the upstream first sheet 104B by sheet control mechanism 180D. The vacuum to second sheet leading end control mechanism 152 is turned off and the vacuum to sheet control mechanism 180D of the first folding roll 170 is turned on by appropriate valving to effectuate the transfer. These sheet portions are positioned proximate gripper 176 of the first folding roll 170 which is passing through the overlap nip 181.

Figure 9:
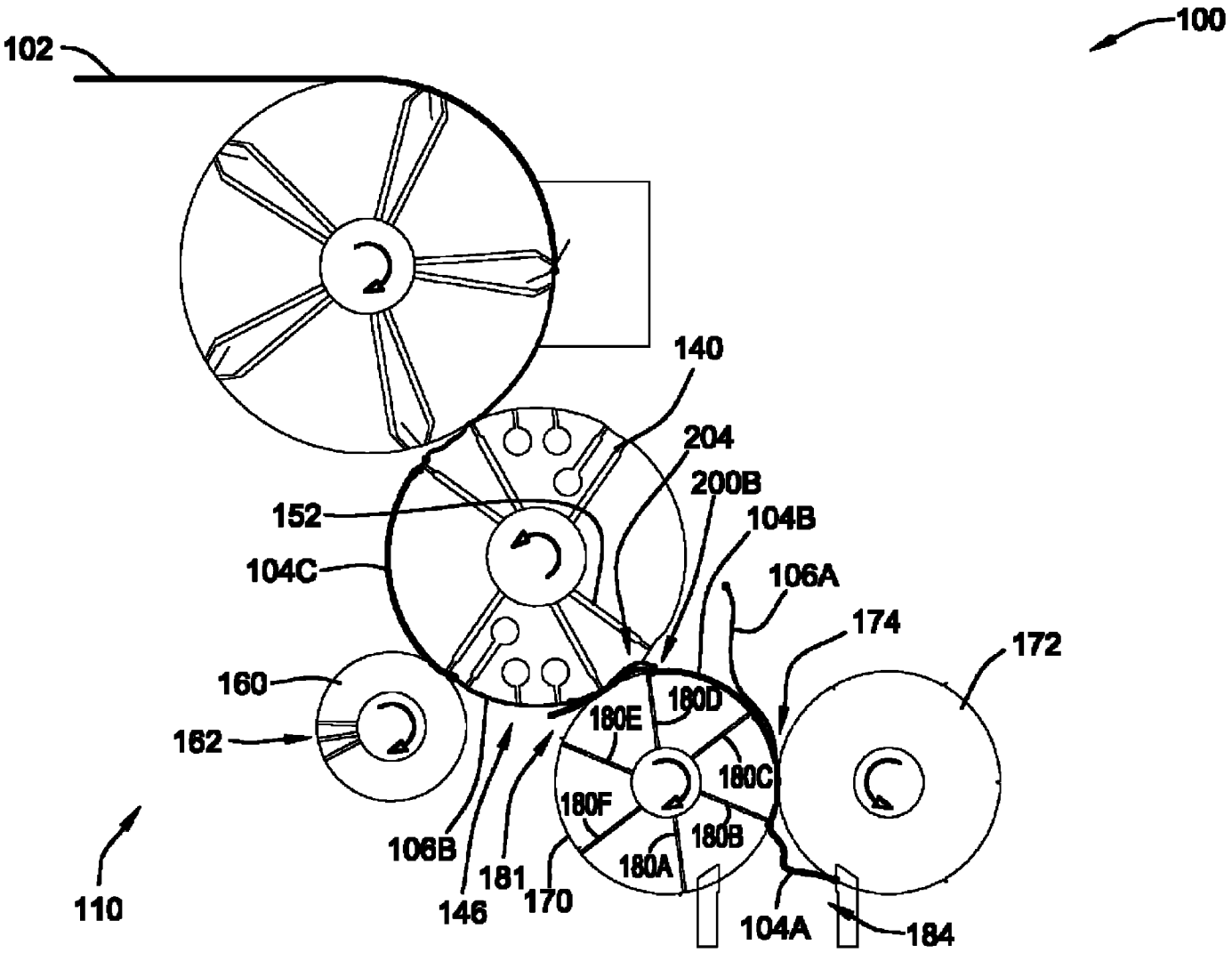

With reference to FIG. 9, the system has indexed forward. In this position, the lap roll 140 begins to pull or otherwise form a bubble/void 200B on the tail end of the upstream first sheet 104B and the leading end of the upstream second sheet 106B as the two sheets 104B, 106B travel through the overlap nip 181. The bubble/void 200B is formed due to the lap roll surface speed being twice the folding roll surface speed. A depression 204 (see also FIG. 1) in the outer periphery of the lap roll, within the second sheet control portion 146 assists in pulling the bubble/void 200B. Depression 204 is adjacent to and upstream from the second sheet leading end control mechanism 152 in the direction of rotation of the lap roll 140.

Figure 10:
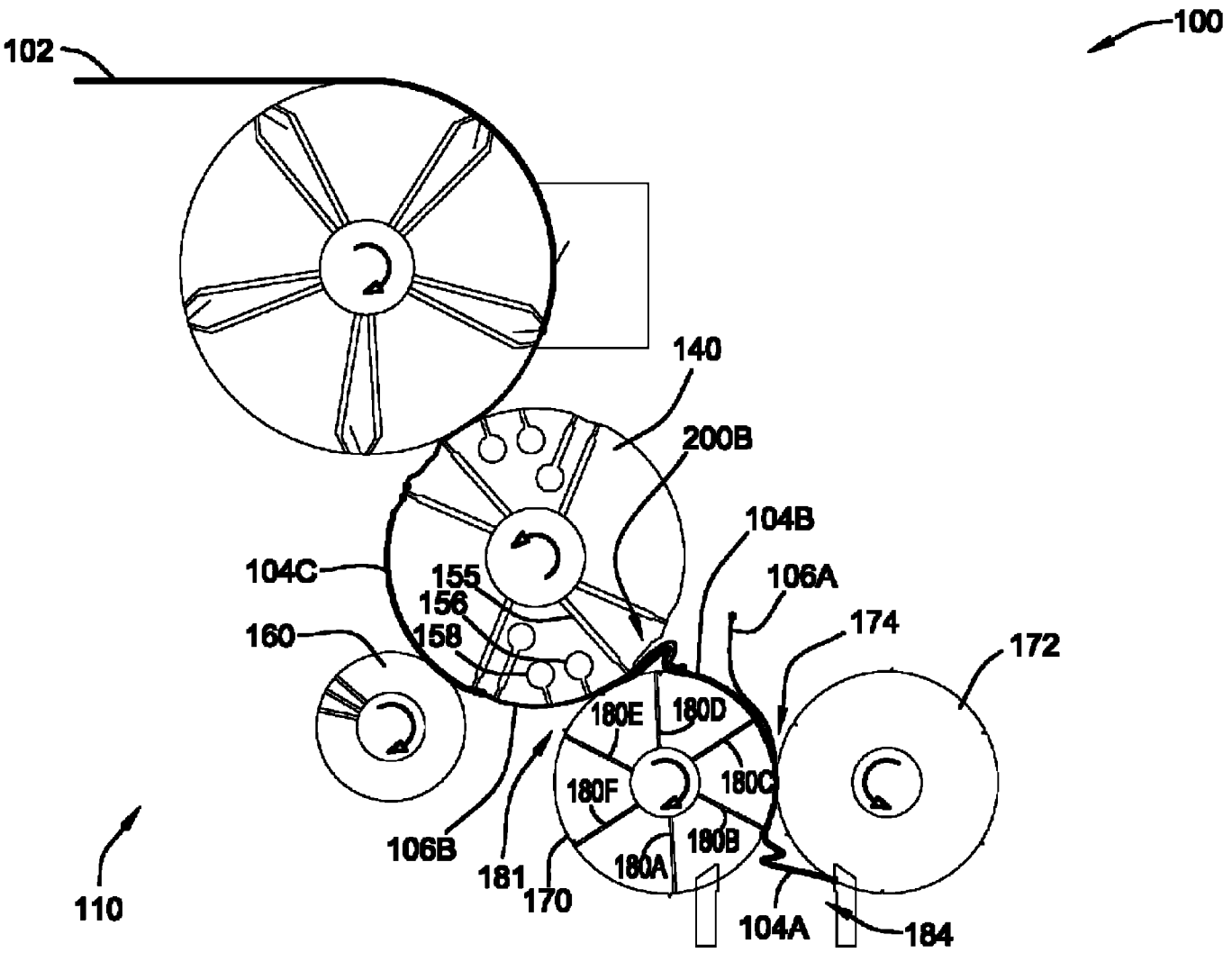
Figure 11:
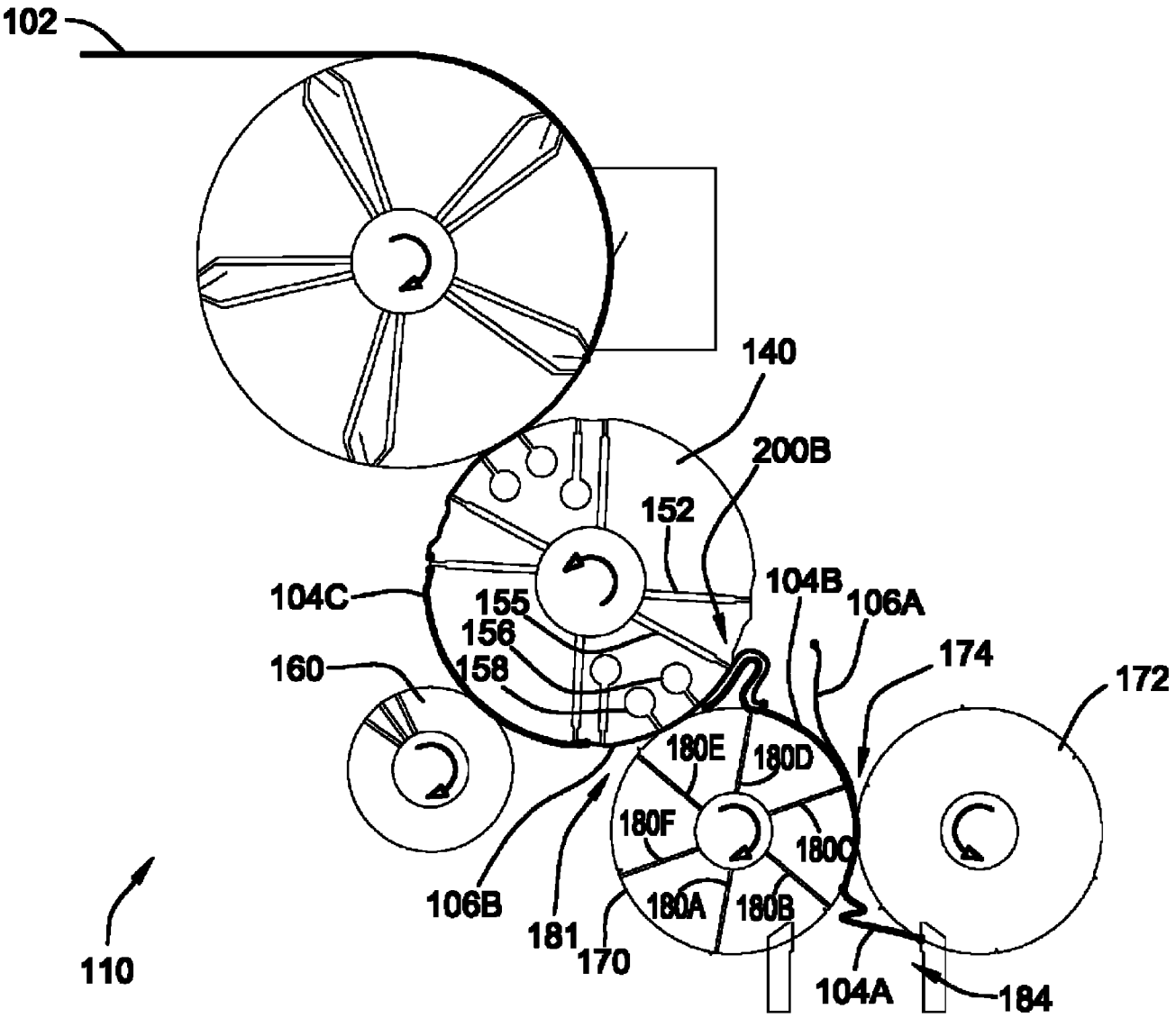
Figure 12:
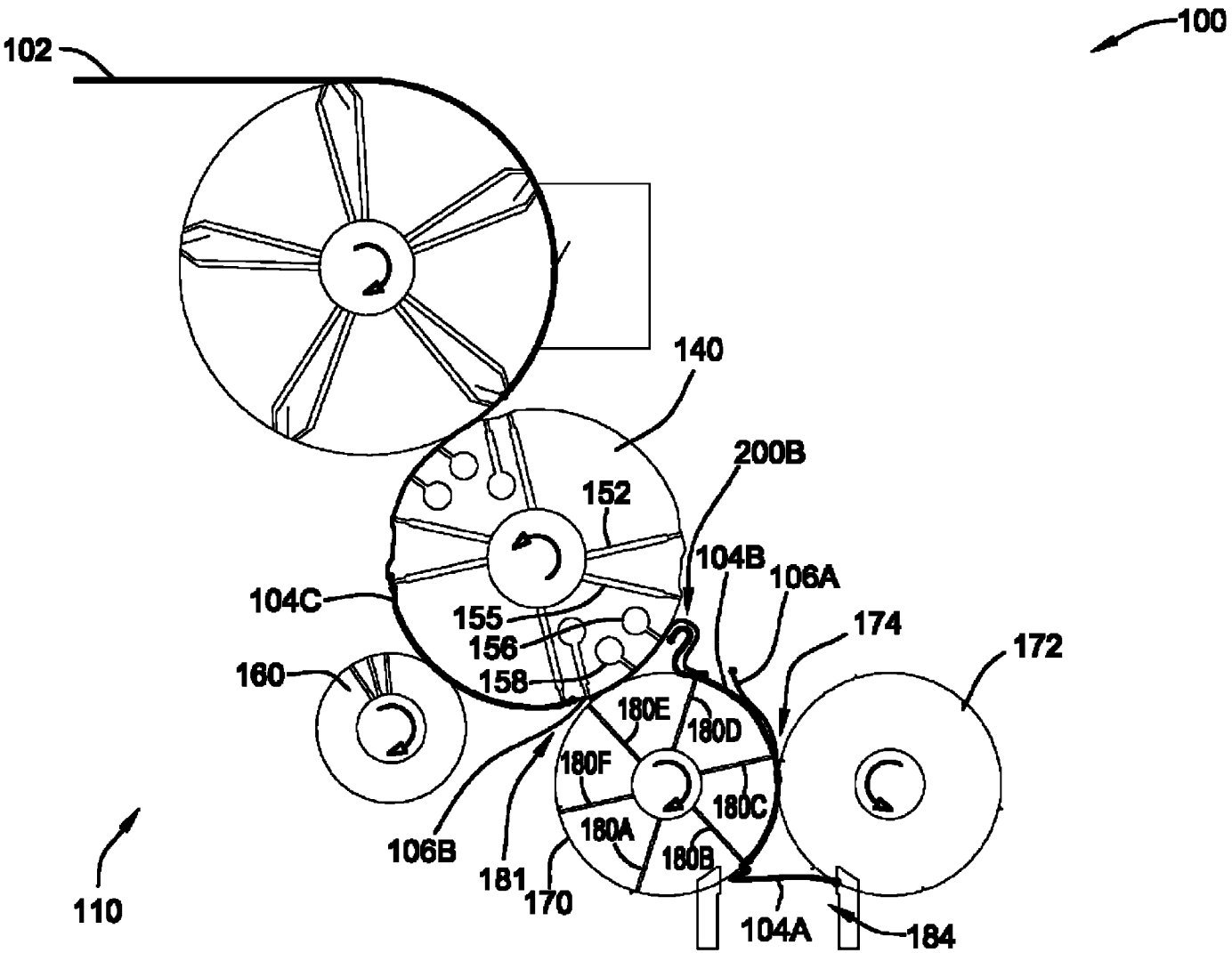

FIGS. 10-12 illustrate the continued growth of bubble/void 200B due to the difference (i.e. double) between the lap roll surface speed and the folding roll surface speed. At least after passing the overlap nip 181, the second sheet intermediate section control mechanisms 155, 156, 158 apply vacuum to the upstream second sheet 106B to grip the upstream second sheet 106B during the bubble/void formation process. In FIG. 12, the system has advanced such that the second sheet intermediate section control mechanism 155 has released the upstream second sheet 106B.

Figure 13:
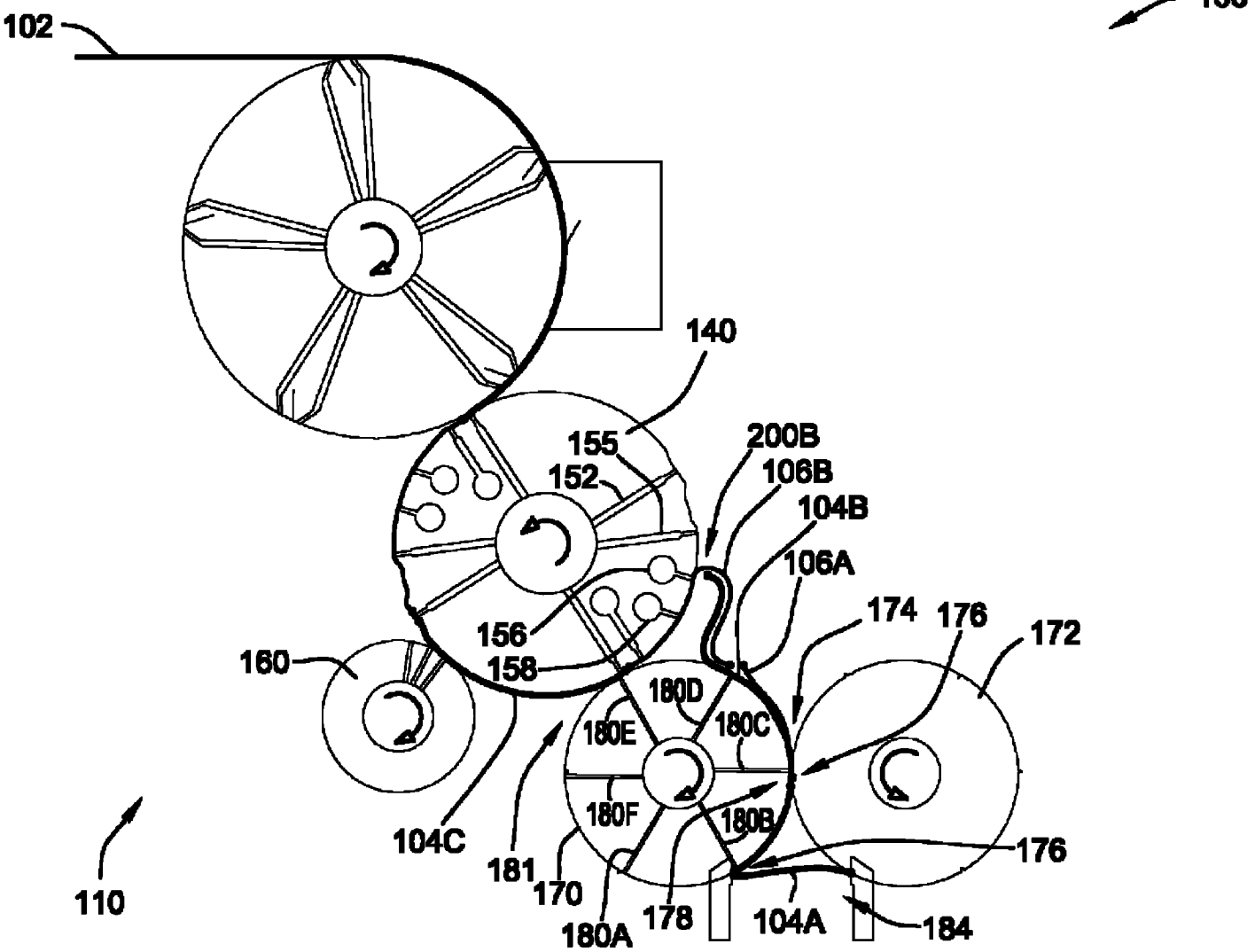

With reference to FIG. 13, the system 100 is in substantially the same orientation as in FIG. 1.

At this point, the gripper 176 of the first folding roll 170 drops the fold formed by the downstream first sheet 104A into the stacking area 184. The gripper 176 of the second folding roll 172 is closing on the tail end of the downstream first sheet 104A, the leading end of the upstream first sheet 104B and the middle of the downstream second sheet 106A forming a fold. The ends of the downstream first sheet 104A and upstream first sheet 104B will be positioned substantially in the fold formed by the downstream second sheet 106A, which may also be referred to as an "on-fold" orientation.

The aforementioned sequence then repeats. With the 50% overlap of the illustrated embodiment and method, the leading end of each first sheet 104 is transferred to a tucker 178 of the first folding roll 170 and the leading end of each second sheet 106 is transferred to a gripper 176 of the first folding roll 170 located on top of the immediately downstream first sheet 104 of the stream of sheets.

The lap roll 140 lifts the tail end of each second sheet 106 along with the tail end of the downstream overlapped first sheet 104 to form the bubble/void 200 to allow the leading end of the upstream first sheet (i.e. immediately upstream of the corresponding second sheet 106) to advance underneath the lifted tail end of the second sheet 106.

Similarly, the tail roll 160 lifts the tail end of each first sheet 104 to form the bubble/void 202 and lets the leading end of the upstream second sheet 106 to advance above the lifted tail end of the first sheet 104.

Figure 14:
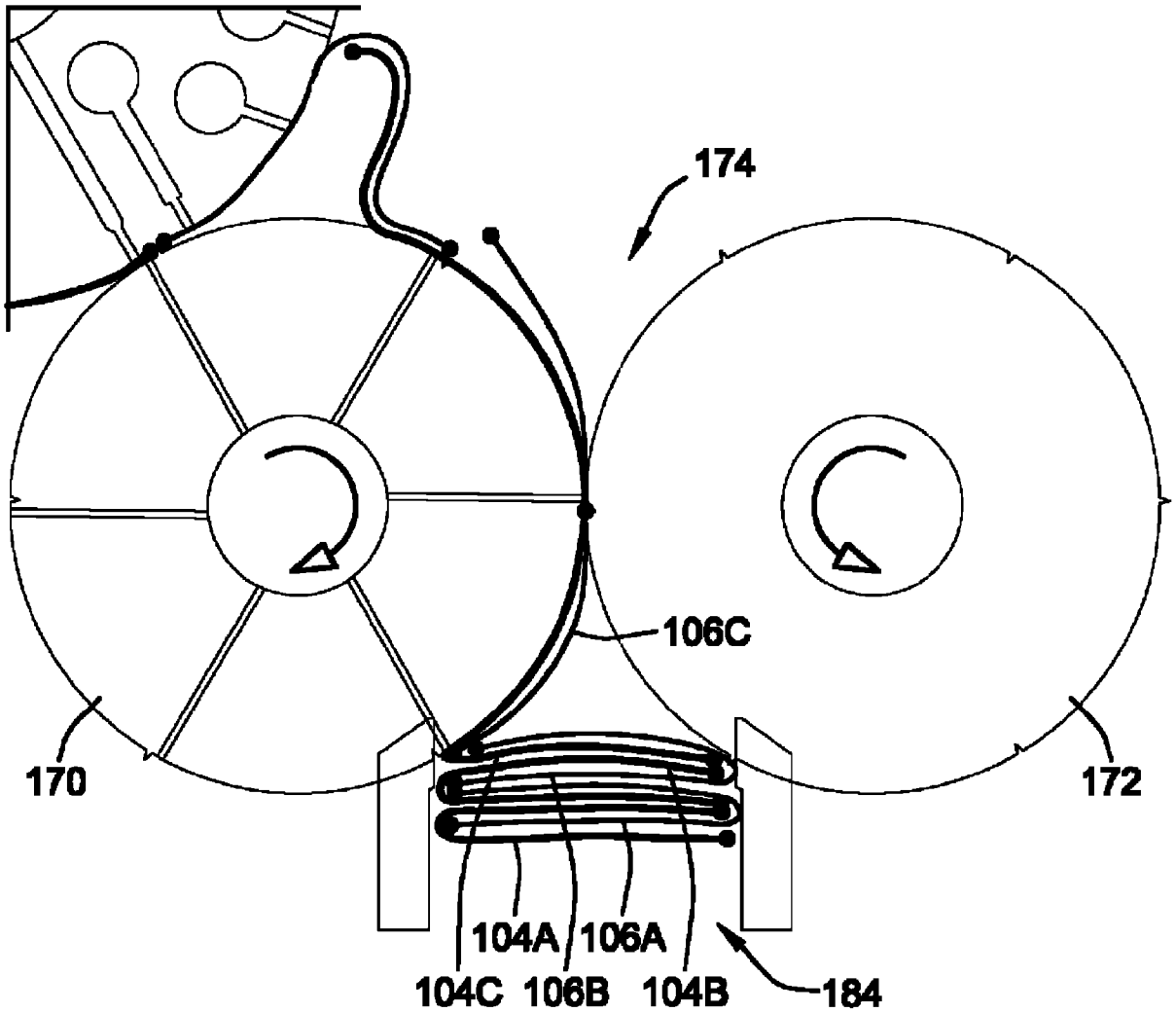

FIG. 14 is an enlarged schematic illustration of the first and second counter-rotating folding rolls 170, 172 and stacking area 184. The system 100 is substantially in the same position as in FIGS. 3 and 13 but advanced several sheets to show a plurality of single-fold interfolded sheets in the stacking area 184.

From this discussion, it is illustrated how all sheets 104, 106 travel along substantially a same sheet path through all of the same nips formed between adjacent components. Further, in this embodiment, all of the sheets are transferred using direct transfer from one roll to another roll within the system. This can be highly beneficial for limp or porous material due to the direct transfer of the sheets from one component to the next.

Other roll configurations can be utilized to achieve direct transfer using a single path to form the alternating sheet overlap.

Figure 15:
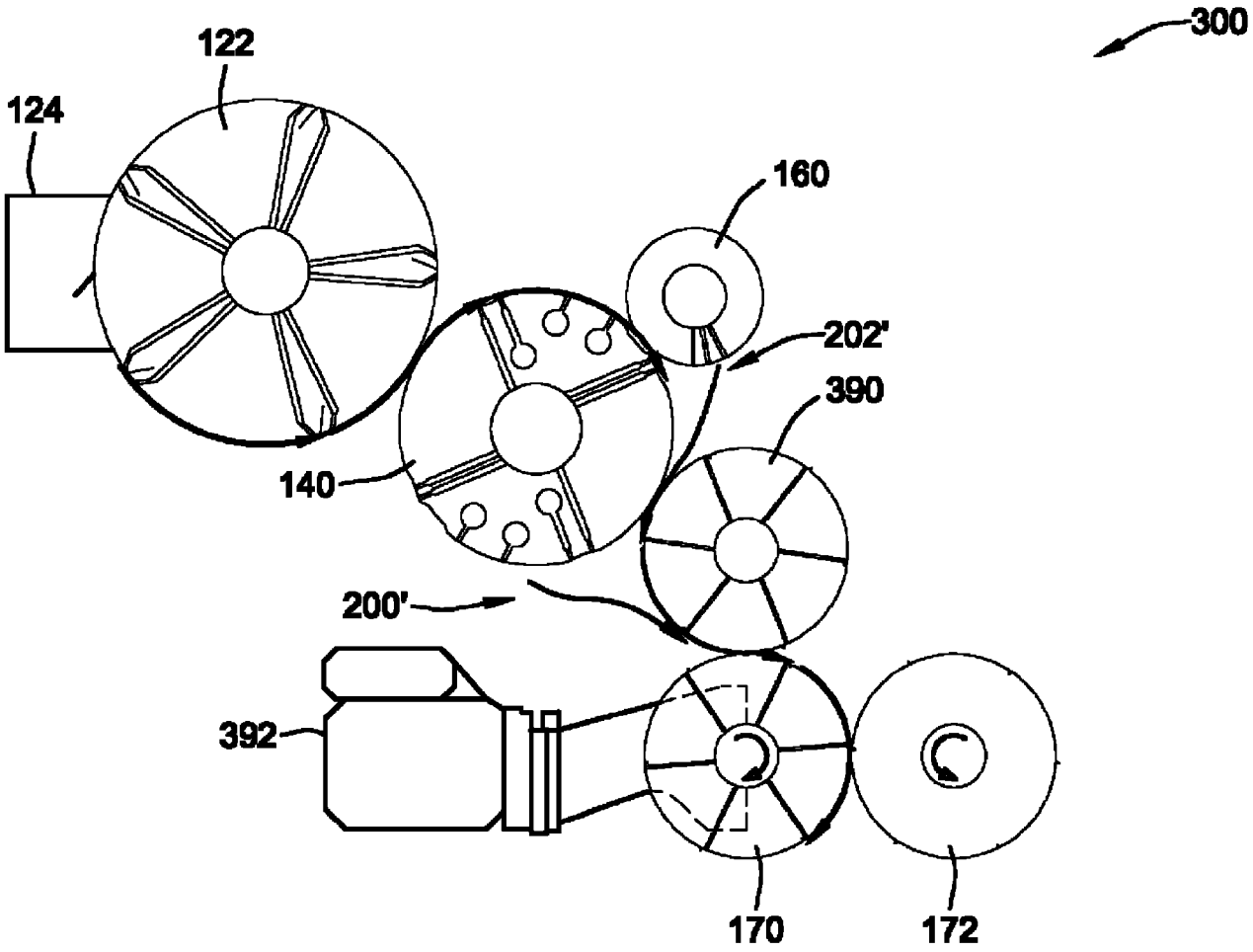
FIG. 15 is a schematic illustration of a further embodiment of a folding apparatus according to the teachings of the present invention.

FIG. 15 illustrates such a further configuration of a system 300. In this system 300, the receiving roll that cooperates with the lap roll 140 takes the form of a transfer roll 390 positioned between the lap roll 140 and the first folding roll 170. This arrangement provides for clearance below the lap roll 140 which can be used to position support structure 392 that supports the first folding roll 170. In this embodiment, the transfer roll 390 operates like the first folding roll 170 in the prior embodiment during the overlapping process upstream of the folding nip. However, the transfer roll 390 does not perform the additional folding functions like the first folding roll 170 in the prior embodiment. Once the first and second sheets are properly overlapped to form the parallel streams of sheets, the parallel streams of sheets are operably transferred from the transfer roll 390 to the folding rolls 170, 172 using known methods.

The prior embodiments can also be operated in a 4-panel, 50% overlap multifold mode by merely switching off the tail roll vacuum such that the tail roll 160 does not lift the tail end of the first sheets.

Figure 16:
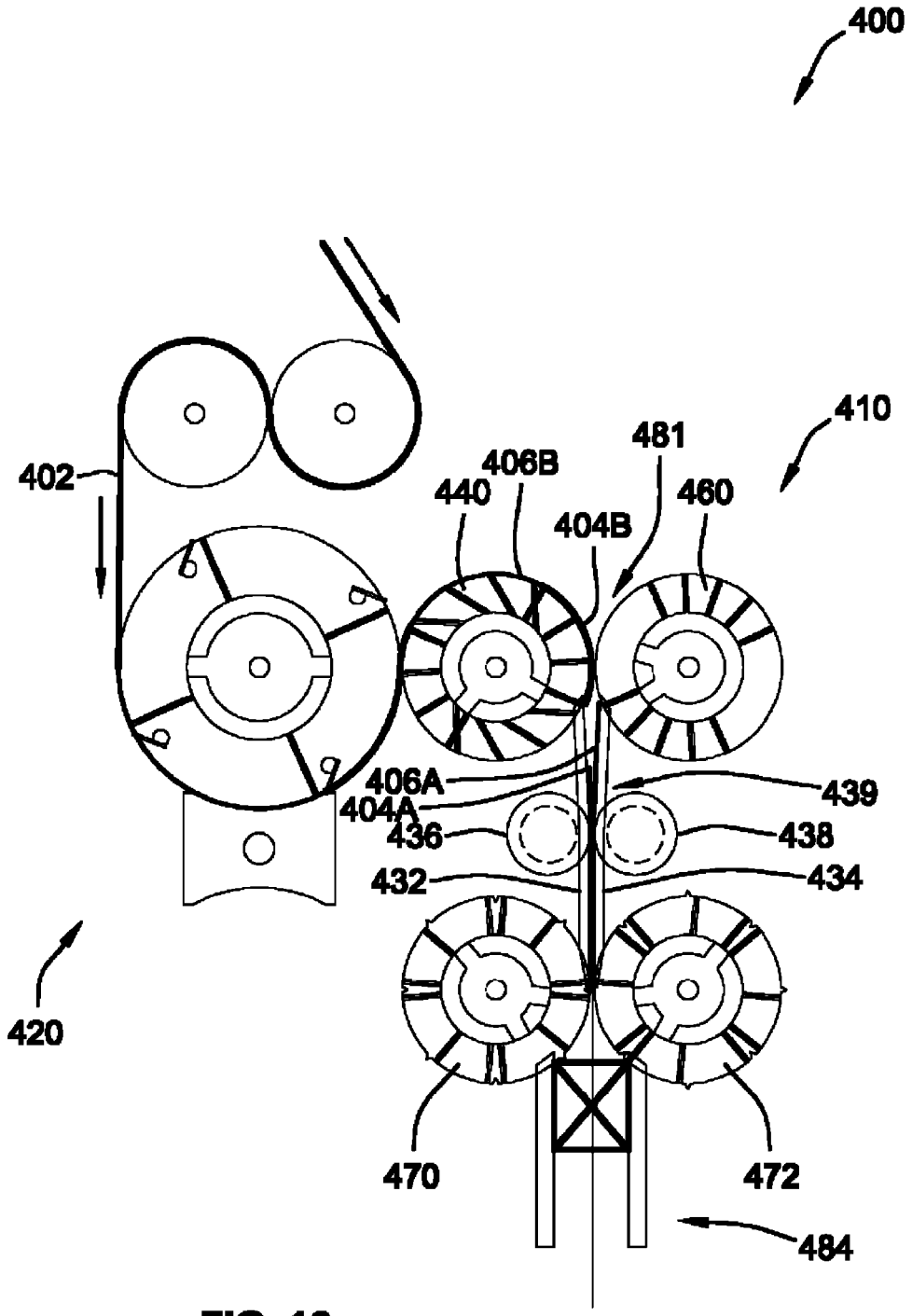
FIGS. 16-20 are schematic illustrations of a further embodiment of a folding apparatus according to the teachings of the present invention.

A further embodiment of a folding apparatus 400 according to the present invention is illustrated in FIG. 16. This embodiment still forms a pattern of sheets as illustrated in FIG. 3 that passes through the folding rolls 470, 472 by passing all sheets in the stream of sheets substantially along a single sheet flow path.

This embodiment converts a continuous web of material 402 into a continuous stream of first and second sheets 404, 406 like the prior embodiment using a cutoff system 420.

The folding apparatus includes an overlap system 410 that again properly orients the stream of first and second sheets 404, 406 into the 50% overlap non-shingled orientation illustrated generally in FIG. 3 that provides the first and second streams of sheets to downstream folding rolls.

The overlap system 410 generally includes a transfer roll 440 and a lifting roll 460 that feed the sheets 404, 406 to a downstream guide arrangement that includes first and second guides 432, 434 that are upstream from first and second retarding rolls 436, 438 to form the desired non-shingled overlap orientation. The sheets 404, 406 travel in the overlapped orientation to the folding rolls 470, 472 to form the desired single-fold interfolded stream of sheets, such as illustrated in FIG. 2.

The transfer roll 440 has a transfer roll surface speed that is equal to the web speed and the lifting roll 460 has a lifting roll surface speed that is also equal to the web speed and the transfer roll surface speed. The first and second retarding rolls 436, 438 have a retarding roll surface speed that is half the web speed and consequently half that of the transfer roll surface speed and the lifting roll surface speed.

The transfer roll 440 receives all sheets 404, 406 from the cutoff system 420. The lifting roll 460 selectively lifts the leading end of each second sheet 406 off of the transfer roll 440 so that each second sheet 406 is transferred to the second guide 434. The second sheets 406 travel down a guide surface of the second guide 434 to a retarding nip 439 formed between the first and second retarding rolls 436, 438 at the web speed (i.e. transfer roll and lifting roll surface speeds). When the leading end of the second sheets 406 has been sufficiently inserted into the retarding nip 439, the leading end of the second sheets 406 is decelerated to the retarding roll surface speed by the first and second retarding rolls 436, 438.

The lifting roll 460 does not engage or grip the first sheets 404 such that the leading end thereof does not transfer to the lifting roll 460. As such, each first sheet 404 is transferred from the transfer roll 440 to the first guide 432. The first sheets 404 travel down a guide surface of the first guide 432 to the retarding nip 439 formed between the first and second retarding rolls 436, 438 whereat the first sheets 404 are decelerated once sufficiently inserted into the retarding nip 439.

Figure 17:
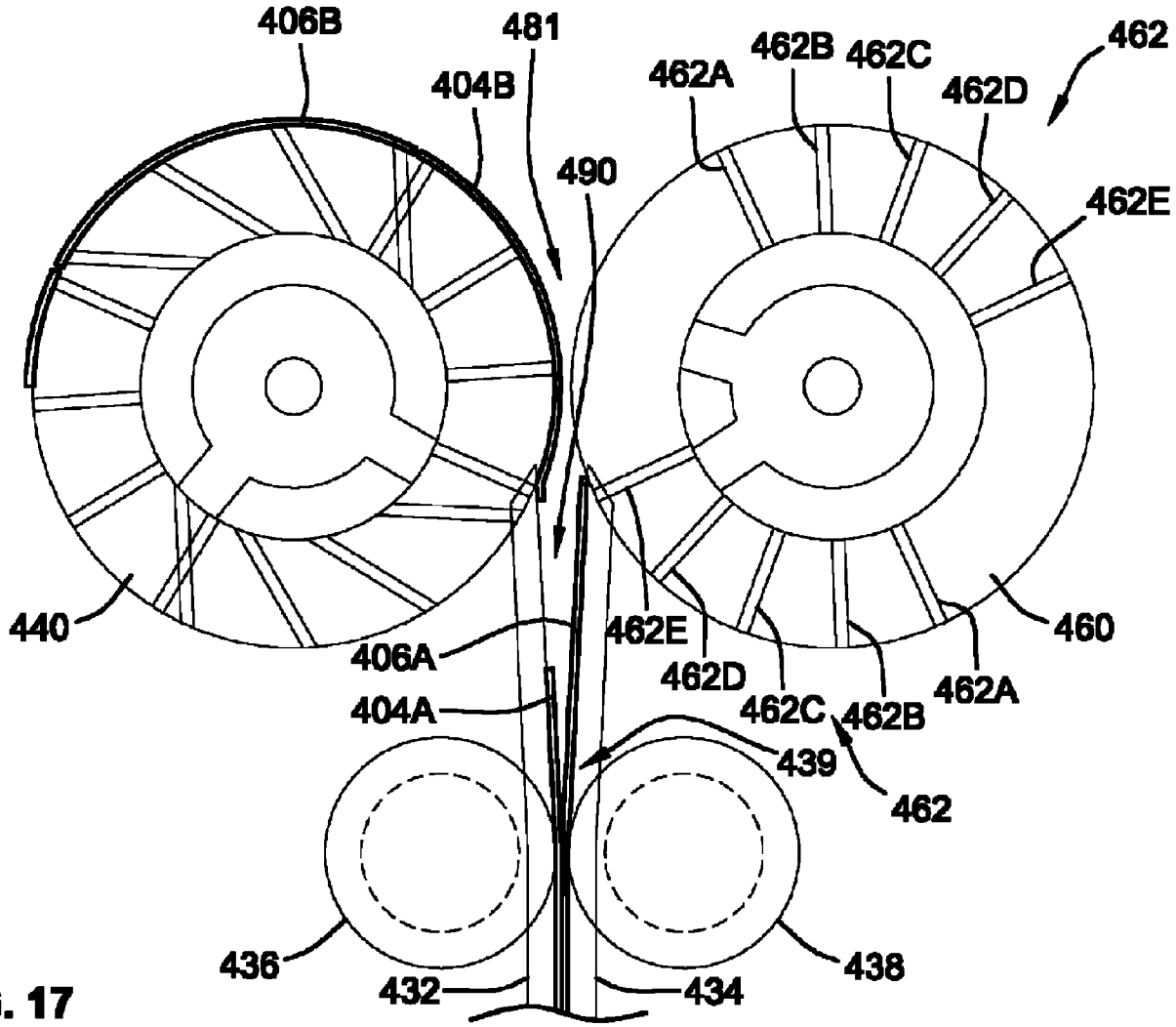

With reference to FIG. 17, a downstream first sheet 404A has been transferred to the first guide 432 by transfer roll 440 as well as to first retarding roll 436. The leading end of the downstream first sheet 404A has passed through the retarding nip 439 and has been engaged by the first retarding roll 436 such that the downstream first sheet 404A has been decelerated to the retarding roll surface speed (i.e. half of web speed). A tail end of the downstream first sheet 404A remains upstream of the retarding nip 404A and is guided by the first guide 432.

A downstream second sheet 406A, which is actually upstream of downstream first sheet 404A, has been transferred to the second guide 434 and has its leading end engaged with the second retarding roll 438. As such, downstream second sheet 406A has decelerated to the retarding roll surface speed as well. At this point, the leading end of the downstream second sheet 406A has overlapped with the tail end of the downstream first sheet 404A, preferably by 50%.

The tail end of the downstream second sheet 406A is engaged by a second sheet control mechanism 462 of the lifting roll 460 that includes five second sheet vacuum ports 462A-462E. The fifth second sheet vacuum port 462E, in this position, is controlling the tail end of the second sheet 406A and is pulling it laterally, i.e. generally perpendicular to the flow path through the first and second guides 432, 434 against second guide 434. This action forms a first sheet receiving gap 490 between the tail end of the downstream second sheet 406A and the guide surface of the first guide 432.

A leading end of the upstream first sheet 404B has passed through a directing nip 481 formed between the transfer roll 440 and the lifting roll 460. The leading end of the upstream first sheet 404B has been transferred from the transfer roll 440 to the first guide 432 axially along the flow path within the first sheet receiving gap 490 and is positioned laterally between the tail end of the downstream second sheet 406A and the first guide 432. A first sheet leading end control mechanism in the form of transfer roll vacuum port 450 may be closed off from vacuum at this point. The upstream first sheet 404B is entering the first and second guides 432, 434 at web speed, i.e. transfer roll surface speed. As such, the leading end of the upstream first sheet 404B can advance past the tail end of the downstream second sheet 406A, which is controlled by the retarding rolls 436, 438.

Notably, no vacuum was applied by the lifting roll 460 to upstream first sheet 404B.

Figure 18:
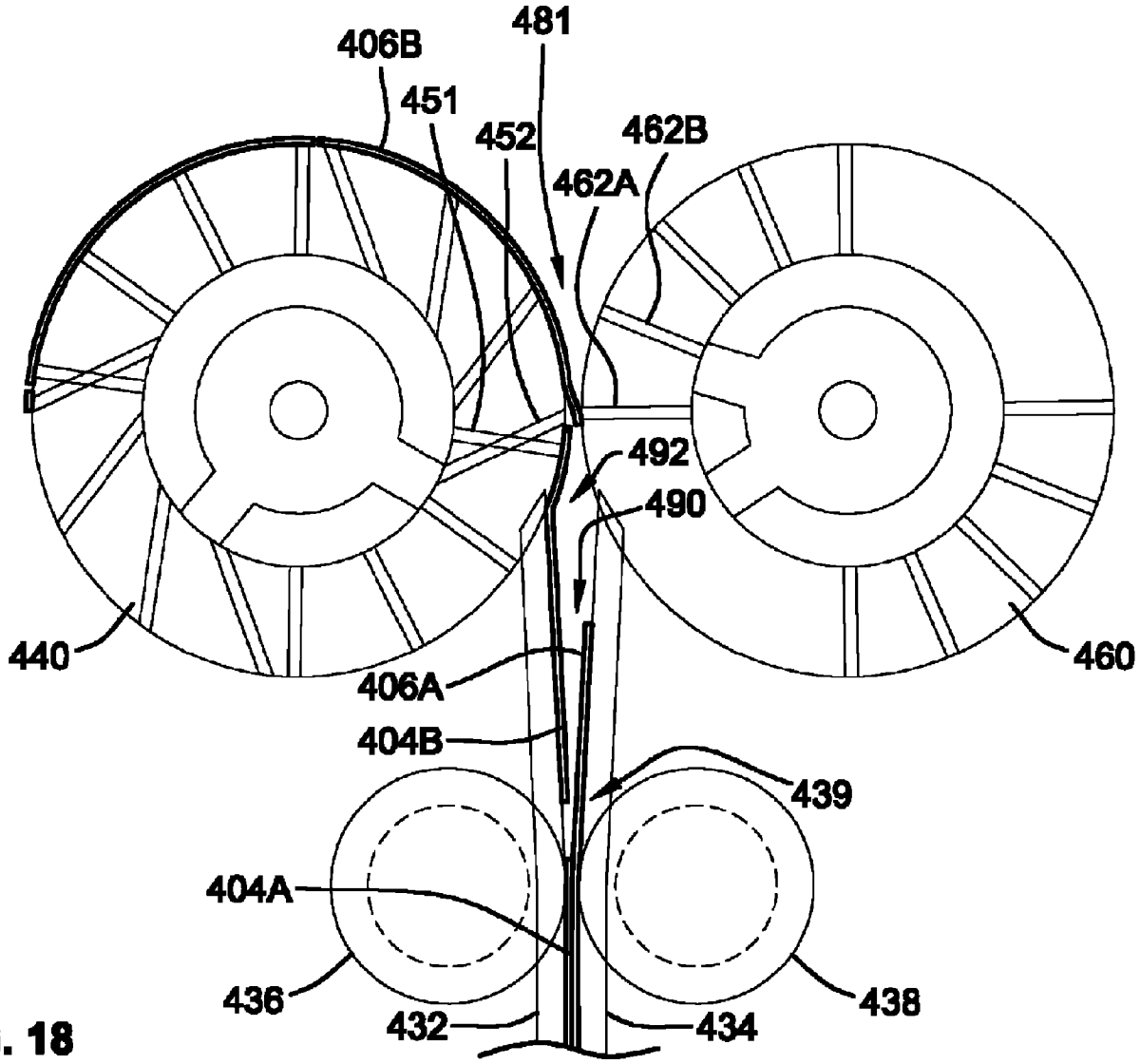

With reference to FIG. 18, the apparatus 400 has advanced from its position in FIG. 17.

In this position, the transfer roll 440 has advanced the upstream first sheet 404B along its stream and the first sheet receiving gap 490 to increase the overlap between the leading end of the upstream first sheet 404B and the tail end of downstream second sheet 406A. The transfer roll 440 maintains control of the tail end of the upstream first sheet 404B with a first sheet trail end control mechanism 451 in the form of a vacuum port (also referred to as "vacuum port 451") to drive it along first guide 432 towards the first retarding roll 436.

The first second sheet vacuum port 462A of the lifting roll 460 has been opened to vacuum and is lifting the leading end of the upstream second sheet 406B off the transfer roll 440 such that the leading end is attached to, transferred to or otherwise gripped by the lifting roll 460. At this point, vacuum can be turned off for the second sheet leading end control mechanism 452 (also referred to as "vacuum port 452") of the transfer roll 440, which is in the form of a vacuum port.

Vacuum port 452 is angled and does not extend radially such that it is closed off from vacuum prior to the upstream vacuum port 451.

Figure 19:
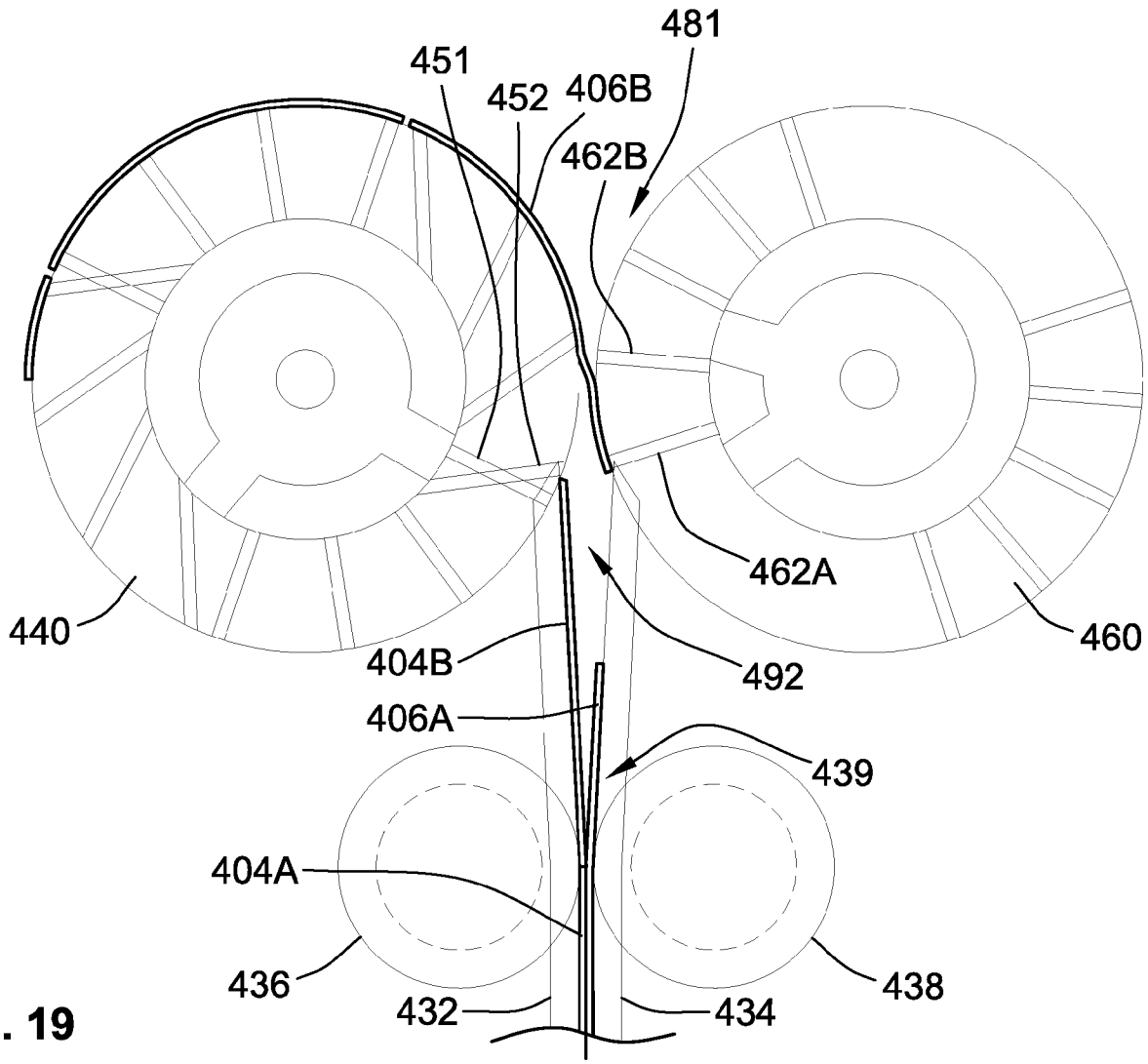

With reference to FIG. 19, the apparatus 400 has advanced from its position in FIG. 18.

In this position, the upstream first sheet 404B has been fully advanced down the first guide 432 to the first retarding roll 436 and decelerated. The tail end of the upstream first sheet 404B is being released by vacuum port 451. A second sheet receiving gap 492 has been formed between the tail end of the upstream first sheet 404B and the second guide 434 for receipt of the leading end of the upstream second sheet 406B.

The length of each sheet is substantially equal to the distance each sheet 404, 406 travels down the corresponding first or second guide 436, 438. In this way, the leading end of each sheet 404, 406 travels down the corresponding guide 432, 434 at the web speed (i.e. transfer roll surface speed) but slows to the retarding roll surface speed as it enters the retarding nip 439.

The leading end of the upstream first sheet 404B has completed the overlap process such that it overlaps the tail end of the downstream second sheet 406A. The upstream first sheet 404B now overlaps the downstream second sheet 406A by approximately 50%. The leading end of the upstream first sheet 404B is positioned adjacent the tail end of downstream first sheet 404A and the middle of downstream second sheet 406A such that they are properly aligned for passage through the folding rolls 470, 472 and engagement by corresponding tuckers and grippers thereof.

The leading end of the upstream second sheet 406B is controlled by the lifting roll 460 and is drawn laterally so that it can be advanced into the second sheet receiving gap 492 formed laterally between the second guide 434 and the tail end of the upstream first sheet 404B. The leading end of the upstream second sheet 406B is beginning to contact the second guide 434.

Figure 20:
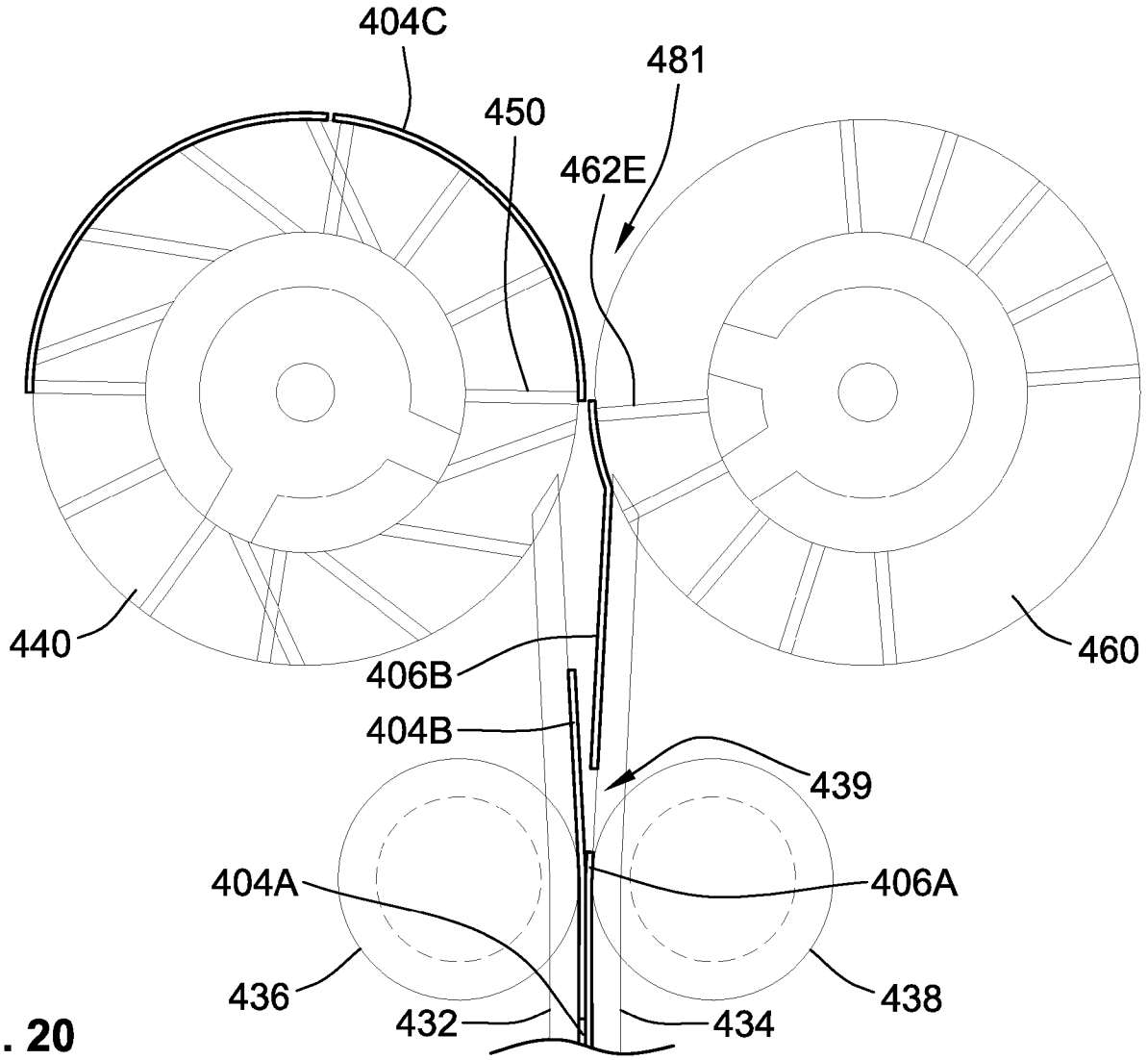

With reference to FIG. 20, the apparatus 400 has advanced forward to a position that is substantially opposite that of FIG. 18.

In this position, the entire upstream second sheet 406B has been transferred from the transfer roll 440 and the leading end of the upstream second sheet 406B has been transferred to the second guide 434. The leading end of the upstream second sheet 406B is traveling at the web speed (i.e. lifting roll surface speed) as the leading end has not yet engaged the second retarding roll 438. Due to the difference in speed between the upstream second sheet 406B and the upstream first sheet 404B due to the upstream second sheet 406B being controlled by the lifting roll 460 and the upstream first sheet 404B being controlled by the first retarding roll 436, the leading end of the upstream second sheet 406B has almost completed the entire 50% overlap with the tail end of the upstream first sheet 404B. The tail end of the upstream second sheet 406B is solely gripped and controlled by the fifth vacuum port 462E and the vacuum to first four vacuum ports 462A-462D has been removed.

As such, the leading end of each second sheet 406 is gripped by the lifting roll 460 and transferred laterally toward the second guide 434 to create the first sheet receiving gap 490 and the leading end of each first sheet 404 is not vacuum gripped by the lifting roll 460 and is transferred to the first guide 432 forming the second sheet receiving gap 492. This alternating process of moving every other sheet between the first and second guides 432, 434 provides the first and second parallel streams of sheets, such as illustrated in FIG. 3.

Preferably, the transfer roll 440, lifting roll 460, and first and second retarding rolls 436, 438 have circumferential grooves in which the first and second guides 432, 434 extend to facilitate removal of sheets 404, 406 therefrom.

This embodiment can also be operated to form the shingled orientation for forming alternative style sheets by turning off the vacuum to the lifting roll 460.

Due to the pushing of the sheets 404, 406 down the first and second guides 432, 434, this embodiment can be advantageous when using stiff and non-porous materials.

All of the rolls above utilize proper valving for selectively activating and deactivating vacuum as is generally well known in the art. The valving operably turns the selected vacuum ports on for a predefined angle and off for a predefined angle.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A folding apparatus for forming a pattern of single-folded interfolded sheets from a single web of material, the folding apparatus comprising:

a sheet cutoff system receiving the single web of material to form a single stream of alternating first and second sheets;

a sheet overlap system downstream from the sheet cutoff system operable in a single-folded interfolded mode to orient the stream of alternating first and second sheets into parallel first and second streams of sheets in an alternating overlap orientation, the first stream of sheets being formed by the first sheets and the second stream of sheets being formed by the second sheets, the alternating overlap orientation has each first sheet overlapped with a tail end of a downstream second sheet downstream from the first sheet and a leading end of an upstream second sheet upstream from the first sheet, with both the tail end of downstream second sheet and the leading end of the upstream second sheet being positioned on a same side of the overlapping first sheet, the tail end of the downstream second sheet being positioned adjacent the leading end of the upstream second sheet;

first and second counter-rotating folding rolls forming a folding nip therebetween for passage through the folding nip the parallel first and second streams of sheets to produce the single-folded interfolded sheets; and the sheet cutoff system, sheet overlap system and first and second counter-rotating folding rolls defining a sheet flow path, all sheets passing along the sheet flow path from the sheet cutoff system through the folding nip.

2. The folding apparatus of claim 1, wherein all sheets pass through the same nips between adjacent components when traveling from the sheet cutoff system through the folding nip.

3. The folding apparatus of claim 1, wherein the sheet overlap system includes a lap roll and a tail roll, the lap roll has a lap roll surface speed, the lap roll operably receives all sheets from the sheet cutoff system, the first and second counter-rotating folding rolls have a folding roll surface speed that is less than the lap roll surface speed, the lap roll and the first counter-rotating folding rolls form an overlap nip therebetween, the tail roll being adjacent the lap roll and forming a tail lifting nip therebetween, the tail lifting nip being upstream from the overlap nip, the tail roll lifting an upstream tail end of each first sheet off of the lap roll after a downstream leading end of that first sheet has been transferred from the lap roll to the first folding roll.

4. The folding apparatus of claim 3, wherein the lap roll retains control of an upstream tail end of each second sheet until after the lap roll has transferred the downstream leading end of a successive upstream first sheet to the first folding roll.

5. The folding apparatus of claim 4, wherein the lap roll retains control of the upstream tail end of each second sheet after the upstream tail end has passed through the overlap nip.

6. The folding apparatus of claim 4, wherein after release of the upstream tail end of each second sheet by the lap roll, the upstream tail end of each second sheet overlaps the downstream leading end of the successive upstream first sheet, the successive first sheet being radially interposed between the second sheet and the first folding roll.

7. The folding apparatus of claim 6, wherein the tail roll retains control of the upstream tail end of each first sheet until after the downstream leading end of each successive upstream second sheet passes through the tail lifting nip.

8. The folding apparatus of claim 7, wherein the tail roll forms a void between the upstream tail end of each first sheet the tail roll controls and the lap roll, the lap roll advancing a downstream leading end of the successive upstream second sheet into the void prior to the upstream tail end of the first sheet being released, the upstream tail end of each first sheet overlapping the downstream leading end of the successive upstream second sheet when released from the tail roll, the successive second sheet being radially interposed between the first sheet and the lap roll.

9. The folding apparatus of claim 4, wherein:

the lap roll includes a first sheet control portion and a second sheet control portion, the first sheet control portion receiving and controlling first sheets from the sheet cutoff system, the second sheet control portion receiving and controlling second sheets from the sheet cutoff system;

the first sheet control portion including:

a first sheet leading end control mechanism actionable to selectively grip the downstream leading end of first sheets and actionable to selectively release the downstream leading end of first sheets;

the second sheet control portion including:

a second sheet leading end control mechanism actionable to selectively grip the downstream leading end of second sheets and actionable to selectively release the downstream leading end of second sheets;

a second sheet tail end control mechanism actionable to selectively grip the upstream tail end of second sheets and actionable to selectively release the upstream tail end of second sheets; and the second sheet tail end control mechanism gripping the upstream tail end of each second sheet until after the leading end control mechanism has released the downstream leading end of the successive upstream first sheet.

10. The folding apparatus of claim 9, wherein:

the first sheet leading end control mechanism is at least one vacuum port;

the second sheet leading end control mechanism is at least one vacuum port; and the second sheet tail end control mechanism is at least one vacuum port.

11. The folding apparatus of claim 9, wherein the second sheet control portion includes at least one second sheet intermediate section control mechanism that is angularly positioned between the second sheet leading end control mechanism and the second sheet tail end control mechanism.

12. The folding apparatus of claim 11, wherein:

the first sheet leading end control mechanism is at least one vacuum port;

the second sheet leading end control mechanism is at least one vacuum port;

the second sheet tail end control mechanism is at least one vacuum port; and the at least one second sheet intermediate section control mechanism is at least one vacuum port.

13. The folding apparatus of claim 1, wherein the sheet overlap system includes a lap roll, a tail roll, and a transfer roll, the lap roll has a lap roll surface speed, the lap roll operably receives all sheets from the sheet cutoff system, the transfer roll has a transfer roll surface speed that is less than the lap roll surface speed, the lap roll and the transfer roll form an overlap nip therebetween, the tail roll being adjacent the lap roll and upstream from the overlap nip, the tail roll lifting an upstream tail end of each first sheet off of the lap roll after a downstream leading end of the first sheet has been transferred from the lap roll to the transfer roll, the overlap nip forming part of the sheet flow path along which all sheets substantially travel and being upstream of the first and second counter-rotating folding rolls.

14. The folding apparatus of claim 13, wherein the lap roll retains control of the upstream tail end of each second sheet until after the lap roll has transferred the downstream leading end of a successive upstream first sheet to the transfer roll.

15. The folding apparatus of claim 1, wherein the sheet overlap system includes:

a transfer roll that operably receives all sheets from the sheet cutoff system, the transfer roll having a transfer roll surface speed;

a lifting roll adjacent the transfer roll forming an directing nip, the lifting roll having a lifting roll surface speed substantially equal to the transfer roll surface speed, first and second retarding rolls forming a retarding nip downstream from the transfer roll and upstream from the folding nip, the first and second retarding rolls have a retarding roll surface speed that is less than the transfer roll surface speed;

first and second sheet guides upstream from and forming an inlet to the retarding nip;

the lifting roll lifting a downstream leading end of each second sheet off of the transfer roll and transferring the downstream leading end of each second sheet to the second sheet guide; and the transfer roll transferring a downstream leading end of each first sheet to the first sheet guide.

16. The folding apparatus of claim 15, wherein a length each sheet travels along the corresponding first or second sheet guide to the corresponding retarding roll is substantially equal to a length of the sheet.

17. The folding apparatus of claim 15, wherein the transfer roll surface speed is twice as fast as the retarding roll surface speed.

18. The folding apparatus of claim 15, wherein the lifting roll retains control of an upstream tail end of each second sheet until the downstream leading end of a successive upstream first sheet has been transferred to the first sheet guide by the transfer roll.

19. The folding apparatus of claim 18, wherein:

the downstream leading end of each first sheet is guided to the retarding nip between the first sheet guide and a downstream second sheet that is being guided by the second sheet guide; and the downstream leading end of each second sheet is guided to the retarding nip between the second sheet guide and a downstream first sheet that is being guided by the first sheet guide.

20. A method of forming a pattern of single-folded sheets from a single web of material, the method comprising feeding the single web of material to a sheet cutoff system;

cutting, using a sheet cutoff system receiving the single web of material to form a single stream of alternating first and second sheets, the single web of material with the sheet cutoff system to form a single stream of alternating first and second sheets;

feeding the single stream of sheets to a sheet overlap system downstream from the sheet cutoff system, the sheet overlap system being downstream from the sheet cutoff system and being operable in a single-folded interfolded mode to orient the stream of alternating first and second sheets into parallel first and second streams of sheets in an alternating overlap orientation, the first stream of sheets being formed by the first sheets and the second stream of sheets being formed by the second sheets;

orienting the single stream of sheets into parallel first and second streams of sheets in an alternating overlap orientation using the overlap system, the alternating overlay orientation has each first sheet overlapped with a tail end of a downstream second sheet downstream from the first sheet and a leading end of an upstream second sheet upstream from the first sheet, with both the tail end of downstream second sheet and the leading end of the upstream second sheet being positioned on a same side of the overlapping first sheet, the tail end of the downstream second sheet being positioned adjacent the leading end of the upstream second sheet;

directing the parallel first and second streams through a folding nip formed between first and second counter-rotating folding rolls to produce the single-folded interfolded sheets; and wherein the sheet cutoff system, sheet overlap system and first and second counter-rotating folding rolls define a sheet flow path, all sheets passing along the sheet flow path from the sheet cutoff system through the folding nip.

21. The method of claim 20, wherein all sheets pass through the same nips between adjacent components when traveling from the sheet cutoff system through the folding nip.

22. The method of claim 20, wherein the step of orienting includes:

receiving each sheet by a lap roll having a lap roll surface speed;

transferring a downstream leading end of each first sheet to the first folding roll having a folding roll surface speed that is less than the lap roll surface speed;

lifting, with a tail roll, an upstream tail end of each first sheet off of the lap roll while the downstream leading end of the first sheet is controlled by the folding roll.

23. The method of claim 22, wherein the step of orienting includes:

retaining control of an upstream tail end of each second sheet, with the lap roll, until after the lap roll has transferred the downstream leading end of the successive upstream first sheet to the first folding roll; and releasing control of the upstream tail end of each second sheet, by the lap roll, after the lap roll has transferred the downstream leading end of each successive upstream first sheet to the first folding roll.

24. The method of claim 23, wherein the step of orienting includes retaining control of the upstream tail end of each second sheet, by the lap roll, after the upstream tail end of each second sheet has passed through an overlap nip formed between the lap roll and the first folding roll.

25. The method of claim 23, wherein the step of orienting includes releasing the upstream tail end of each second sheet by the lap roll; wherein after being released, the upstream tail end of each second sheet overlaps the downstream leading end of the successive upstream first sheet, which has been transferred to the first folding roll, the successive upstream first sheet radially interposed between the second sheet and the first folding roll.

26. The method of claim 25, wherein the step of lifting includes retaining control of the upstream tail end of each first sheet, with the tail roll, until after the downstream leading end of each successive upstream second sheet passes through a tail lifting nip formed between the tail roll and the lap roll.

27. The method of claim 23, wherein the sheets are controlled by the lap roll, tail roll and first and second counter-rotating folding rolls using vacuum.

28. The method of claim 23, wherein the step of retaining control of the upstream tail end of each second sheet includes forming a void between the first folding roll and the second sheet; and further comprising advancing the downstream leading end of the successive upstream first sheet with the first folding roll into the void.

29. The method of claim 20, wherein the step of orienting includes:

receiving each sheet by a lap roll having a lap roll surface speed;

transferring, from the lap roll, a downstream leading end of each first sheet to a transfer roll having a transfer roll surface speed that is less than the lap roll surface speed;

lifting, with a tail roll, an upstream tail end of each first sheet off of the lap roll while the downstream leading end of the first sheet is controlled by the transfer roll.

30. The folding apparatus of claim 29, wherein the step of orienting includes:

retaining control of an upstream tail end of each second sheet, with the lap roll, until after the lap roll has transferred the downstream leading end of the successive upstream first sheet to the transfer roll; and releasing control of the upstream tail end of each second sheet, by the lap roll, after the lap roll has transferred the downstream leading end of each successive upstream first sheet to the transfer roll.

31. The method of claim 29, wherein the step of orienting includes retaining control of the upstream tail end of each second sheet, by the lap roll, after the upstream tail end of each second sheet has passed through an overlap nip formed between the lap roll and the transfer roll.

32. The method of claim 20, wherein the step of orienting includes:

receiving each sheet by a transfer roll of the sheet overlap system having a transfer roll surface speed;

transferring, with the transfer roll, a downstream leading end of each first sheet to a first sheet guide downstream from the transfer roll and upstream from the folding nip;

lifting, with a lifting roll, a downstream lead end of each second sheet off of the transfer roll, the lifting roll having a lifting roll surface speed substantially equal to the transfer roll surface speed transferring, with the lifting roll, the downstream leading end of each second sheet to a second sheet guide downstream from the lifting roll; and retarding, operably, a speed of the sheets along the sheet flow path with first and second retarding rolls forming a retarding nip downstream from the transfer roll and upstream from the folding nip, the first and second retarding rolls have a retarding roll surface speed that is less than the transfer roll surface speed.

33. The method of claim 32, wherein a length each sheet travels down the corresponding first or second sheet guide to the corresponding retarding roll is substantially equal to a length of the sheet.

34. The method of claim 32, wherein the transfer roll surface speed is twice as fast as the retarding roll surface speed, and wherein the step of retarding includes passing a downstream half of a first sheet through the retarding nip substantially aligned with an upstream half of a downstream second sheet and passing an upstream half of the first sheet through the retarding nip substantially aligned with a downstream half of an upstream second sheet.

35. The method of claim 32, wherein the step of orienting includes retaining control of an upstream tail end of each second sheet, with the lifting roll, until a downstream leading end of a successive upstream first sheet has been transferred to the first sheet guide by the transfer roll.

36. The method of claim 35, wherein the step of orienting includes:

guiding a downstream leading end of each first sheet to the retarding nip between the first sheet guide and a second sheet that is being guided by the second sheet guide; and guiding a downstream leading end of each second sheet to the retarding nip between the second sheet guide and a first sheet that is being guided by the first sheet guide.

37. A folding apparatus for forming a pattern of single-folded interfolded sheets from a single web of material, the folding apparatus comprising:

a sheet cutoff means for forming a single stream of alternating first and second sheets from the single web of material;

a sheet overlap means operable in a single-folded interfolded mode for orienting the stream of alternating first and second sheets into parallel first and second streams of sheets in an alternating overlap orientation, the first stream of sheets being formed by the first sheets and the second stream of sheets being formed by the second sheets, the sheet overlap means being downstream from the sheet cutoff means, the alternating overlap orientation has each first sheet overlapped with a tail end of a downstream second sheet downstream from the first sheet and a leading end of an upstream second sheet upstream from the first sheet, with both the tail end of downstream second sheet and the leading end of the upstream second sheet being positioned on a same side of the overlapping first sheet, the tail end of the downstream second sheet being positioned adjacent the leading end of the upstream second sheet;

first and second counter-rotating folding rolls forming a folding nip therebetween for passage through the folding nip the parallel first and second streams of sheets to produce the single-folded interfolded sheets; and the sheet cutoff means, sheet overlap means and first and second counter-rotating folding rolls defining a sheet flow path, all sheets passing along the sheet flow path from the sheet cutoff means through the folding nip.

38. The folding apparatus of claim 37, wherein all sheets pass through the same nips between adjacent components when traveling from the sheet cutoff means through the folding nip.

* * * * *